US010566736B2

(12) United States Patent
Tanaka et al.

(10) Patent No.: US 10,566,736 B2
(45) Date of Patent: Feb. 18, 2020

(54) BOARD-TO-BOARD CONNECTOR WITH SLIDING LOCK

(71) Applicant: Molex, LLC, Lisle, IL (US)

(72) Inventors: Daiki Tanaka, Yamato (JP); Yuji Naito, Yamato (JP); Mei Naito, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/217,508

(22) Filed: Dec. 12, 2018

(65) Prior Publication Data

US 2019/0190201 A1 Jun. 20, 2019

(30) Foreign Application Priority Data

Dec. 14, 2017 (JP) ..... 2017-239858

(51) Int. Cl.

| | |
|---|---|
| ***H01R 12/71*** | (2011.01) |
| ***H01R 13/627*** | (2006.01) |
| ***H01R 13/631*** | (2006.01) |
| ***H01R 12/73*** | (2011.01) |
| *H01R 13/436* | (2006.01) |
| *H01R 13/629* | (2006.01) |
| *H01R 12/00* | (2006.01) |
| *H01R 12/52* | (2011.01) |
| *H01R 13/639* | (2006.01) |

(52) U.S. Cl.

CPC ..... *H01R 13/6273* (2013.01); *H01R 12/716* (2013.01); *H01R 12/73* (2013.01); *H01R 13/6275* (2013.01); *H01R 13/631* (2013.01); *H01R 12/00* (2013.01); *H01R 12/52* (2013.01); *H01R 13/4361* (2013.01); *H01R 13/629* (2013.01); *H01R 13/639* (2013.01)

(58) Field of Classification Search

CPC ..... H01R 13/4361; H01R 13/639; H01R 13/629; H01R 12/00; H01R 12/52; H01R 12/716

USPC ..... 439/347, 74, 345

See application file for complete search history.

(56) References Cited

U.S. PATENT DOCUMENTS 9,331,410 B2 * 5/2016 Obikane ..... H01R 13/02

FOREIGN PATENT DOCUMENTS

JP 04368783 A * 12/1992
JP H04-368783 A 12/1992

* cited by examiner

*Primary Examiner* — Abdullah A Riyami
*Assistant Examiner* — Justin M Kratt
(74) *Attorney, Agent, or Firm* — Molex, LLC

(57) ABSTRACT

Provided is a connector comprising: a connector body; a terminal attached to the connector body; and a slider attached to the connector body, wherein the connector body includes mating-guide parts formed on two ends, in the longitudinal direction, of the connector body; the mating guide parts mate with counterpart mating-guide parts formed on the two ends, in the longitudinal direction, of a counterpart connector body of a counterpart connector; the slider includes a front-side locking part and a rear-side locking part, and is slidable, in the longitudinal direction of the connector body, between a locked position and an unlocked position; and once the connector body mates with the counterpart connector body, and the slider slides and thus reaches the locked position, the front-side locking part and the rear-side locking part engage with a right-and-left pair of to-be-locked parts of the counterpart locking member attached to each of the counterpart mating-guide part.

8 Claims, 19 Drawing Sheets

BOARD-TO-BOARD CONNECTOR WITH SLIDING LOCK

RELATED APPLICATIONS

This application claims priority to Japanese Application No. 2017-239858, filed Dec. 14, 2017, which is incorporated herein by reference in its entirety.

TECHNICAL FIELD

The present disclosure relates to a connector and a connector assembly.

BACKGROUND ART

Conventionally, connectors such as board to board connectors, etc., have been used to electrically connect pairs of parallel circuit boards to each other. Such connectors are attached to each of the mutually facing surfaces of pairs of circuit boards. When the connectors are mated together, an electrically conductive connection is established between the connectors. A technique was proposed to prevent the electrically connected state from being canceled even when the connectors are subjected to an external force or the like (e.g., see Patent Document 1).

FIG. 19 is a partial cross-sectional view of a conventional connector.

The figure shows a first housing 811 serving as a housing of a first connector mounted to a first circuit board 891, and a second housing 911 serving as a housing of a second connector mounted to a second circuit board 991. A plurality of first terminals 861 are disposed on the first housing 811, and a plurality of second terminals 961 which are in contact with the first terminals 861, are disposed on the second housing 911.

In addition, lock levers 851 are disposed on the first housing 811, and are operable to lock the second housing 911 after the second housing 911 is mated with the first housing 811. Each of the lock levers 851 includes a spring 853. Once the first housing 811 and the second housing 911 are mated together, the extending spring 853 exerts a force on the lock lever 851 to make the distal end part 852 of lock lever 851 advance into and engage with an engagement hole 951 formed on the second housing 911. Hence, even when an external force or the like acts on the first housing 811 and the second housing 911 in the mated state, the first housing 811 and the second housing 911 stay mated with each other and the electrically connected state between the first housing 811 and the second housing 911 can be securely maintained.

Patent Document 1: Japanese Unexamined Patent Application Publication No. H04-368783

SUMMARY

However, in the aforementioned conventional connector, just one lock lever 851 having the distal end part 852, which engages with the engagement hole 951 is disposed on the left-hand side of the first housing 811 and just another such lock lever 851 is disposed on the right-hand side thereof. Likewise, just one engagement hole 951 is disposed on the left-hand side of the second housing 911 and just another engagement hole 951 is disposed on the right-hand side thereof.

Hence, in some cases, the engagement of the engagement holes 951 and the distal end parts 852 of lock levers 851 may be disengaged and the mutually mated first housing 811 and second housing 911 may be separated from each other if an external force acts on the first and the second housings 811 and 911 in a direction oblique with respect to the mating direction of first housing 811 and second housing 911. An example of such oblique external force is one that is generated when the second circuit board 991 is urged against the first circuit board 891.

An objective of this disclosure is to solve the problem of the aforementioned conventional connector and provide a highly reliable connector and a highly reliable connector assembly wherein the connector is securely locked to the mated counterpart connector and securely stays mated with the counterpart connector.

A connector is provided to this end. The connector includes: a connector body; a terminal attached to the connector body; and a slider attached to the connector body. In the connector, the connector body includes mating-guide parts formed on two ends, in the longitudinal direction, of the connector body. The mating guide parts mate with counterpart mating-guide parts formed on the two ends, in the longitudinal direction, of a counterpart connector body of a counterpart connector. The slider includes a front-side locking part and a rear-side locking part, and is slidable, in the longitudinal direction of the connector body, between a locked position and an unlocked position. Once the connector body mates with the counterpart connector body, and the slider slides and thus reaches the locked position, the front-side locking part and the rear-side locking part engage with a right-and-left pair of to-be-locked parts of the counterpart locking member attached to each of the counterpart mating-guide part.

In a different connector, the slider may further include: a right-and-left pair of side frames extending along a side wall part of the connector body in the longitudinal direction of the connector body; a pair of end-part-coupling frames disposed in each of the mating guide parts and configured to couple two ends of the side frames at a front position and to couple two ends thereof at a rear position; and an operation part formed in one of the end-part-coupling frames.

A still different connector may further include a shell attached fixedly to the connector body and including: a right-and-left pair of side frames disposed on outer sides of the side frames of the slider and extending in the longitudinal direction of the connector body; and a pair of end-part-coupling frames disposed on outer sides of the end-part-coupling frames of the slider. In the still different connector, the end-part-coupling frames of the shell may include stopper parts configured to stop the slider at the locked position or the unlocked position.

A still different connector may further include a biasing member mounted in the connector body. In the still different connector, the biasing member may bias the slider towards the locked position.

In a still different connector, furthermore, in a case where the connector body is mated with the counterpart connector body: if the front-side locking part and the rear-side locking part are brought into contact with sloping parts formed in the to-be-locked parts and thus receive a force directed towards an unlocked position from the sloping part, the slider may slide and thus reach an unlocked position, and if the front-side locking part and the rear-side locking part pass through the to-be-locked parts in a mating direction, a biasing force of the biasing member may make the slider slide and thus reach to a locked position, and the front-side locking part and the rear-side locking part may engage with the to-be-locked parts.

A still different connector may further include an engagement member configured to engage with the slider. In the still different connector the slider may be engaged with by the engagement member at the locked position and at the unlocked position.

In a still different connector, furthermore, the engagement member may be a leaf spring whose free end is elastically displaceable in the width direction of the connector body; and the engagement projection formed in a vicinity of the free end may engage with the engagement projection of the slider, and the engagement projection may thus engage with the slider.

A connector assembly is provided. The connector assembly includes: a connector of the present disclosure; and a counterpart connector including a counterpart connector body. In the connector assembly, the counterpart connector body may include counterpart mating guide parts formed at two ends, in the longitudinal direction, of the counterpart connector body. The counterpart mating guide parts may be configured to mate with mating guide parts of the connector. To the counterpart mating guide parts of the counterpart connector body, counterpart locking members may be attached.

The connector according to the present disclosure is securely locked to the mated counterpart connector. Consequently, the mating of the connector and the counterpart connector is securely maintained and reliability improves.

BRIEF DESCRIPTION OF THE DRAWINGS

FIG. 1A is a view from a mating face side, and FIG. 1B is a view from a mounting face side.

FIG. 2A is a top view, and FIG. 2B is a side view.

FIG. 3A is a view from a mounting face side, and FIG. 3B is a view from a mating face side.

FIG. 4A is a top view, and FIG. 4B is a side view.

FIG. 5A is a top view, and FIG. 5B is a cross-sectional view along the line A-A seen from arrows A in FIG. 5A.

FIG. 8A is a top view, and FIG. 8B is a cross-sectional view along the line B-B seen from arrows B in FIG. 8A.

FIG. 10A is a view from a mating face side, and FIG. 10B is a view from a mounting face side.

FIG. 11A is a top view, and FIG. 11B is a side view.

FIG. 13A is a view from a mounting face side, and FIG. 13B is a view from a mating face side.

FIG. 14A is a top view, and FIG. 14B is a side view.

FIG. 15A is a top view, and FIG. 15B is a cross-sectional view along the line C-C seen from arrows C in FIG. 15A.

FIG. 17A is a top view, and FIG. 17B is a cross-sectional view along the line D-D seen from arrows D in FIG. 17A.

DETAILED DESCRIPTION OF THE PREFERRED EMBODIMENTS

Embodiments will be described in detail below with reference to the drawings.

Figure 1B:
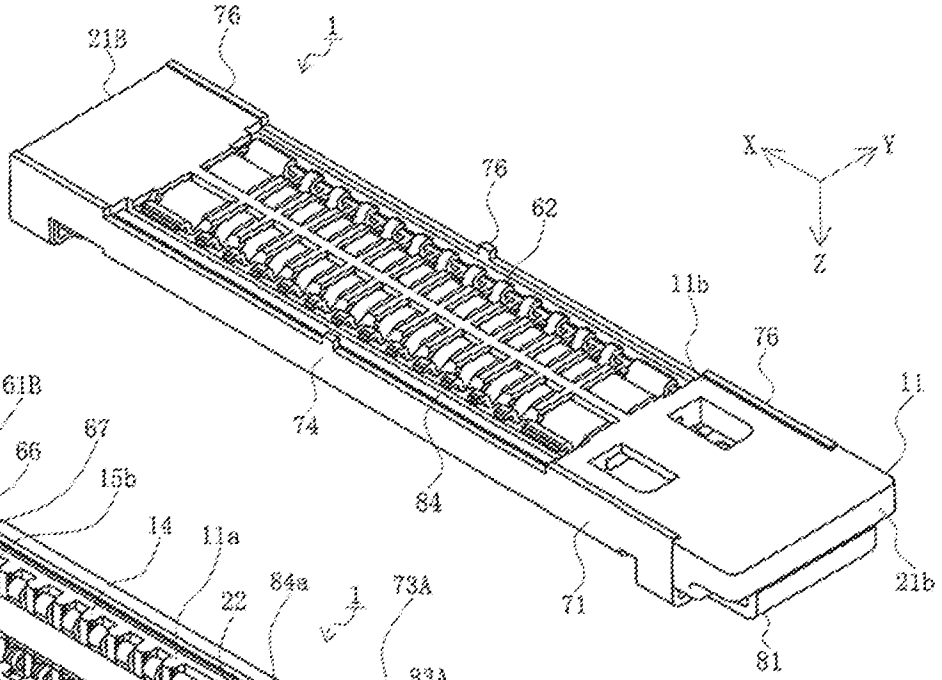
FIGS. 1A and 1B show perspective views of a first connector according to a first embodiment.
Figure 1A:
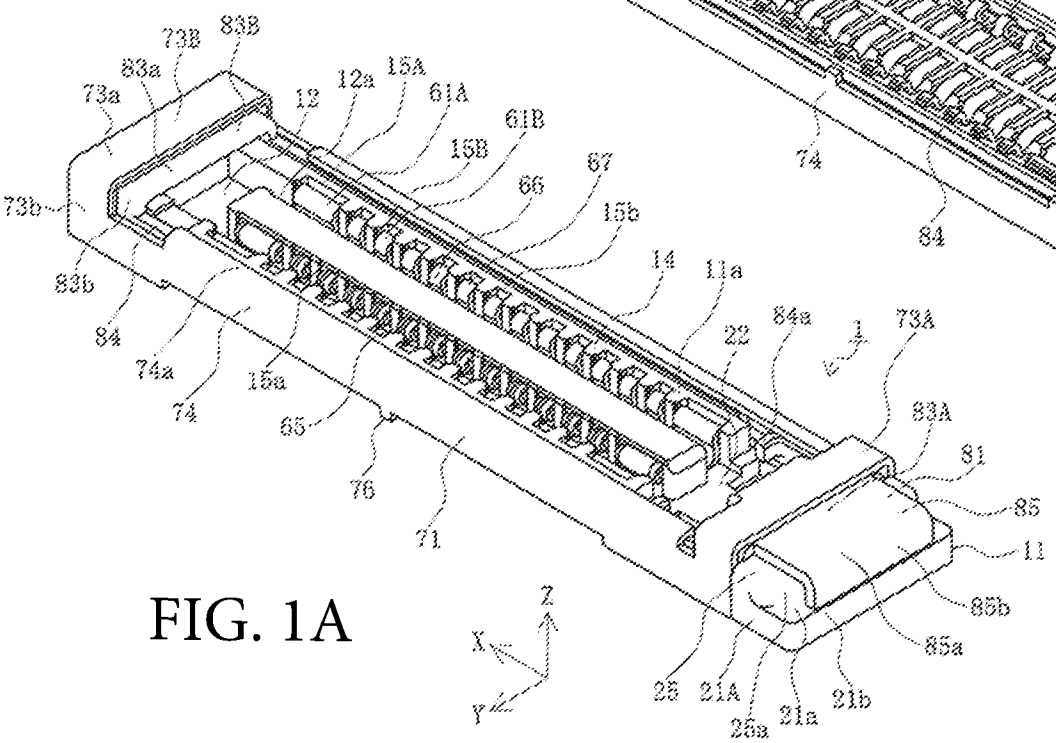
Figure 2A:
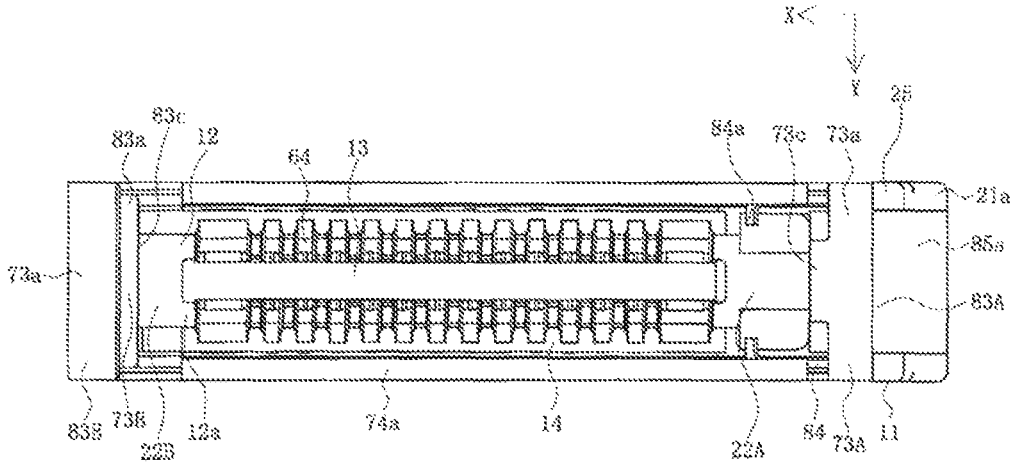
FIGS. 2A and 2B are two-surface views of the first connector according to the first embodiment.
Figure 2B:
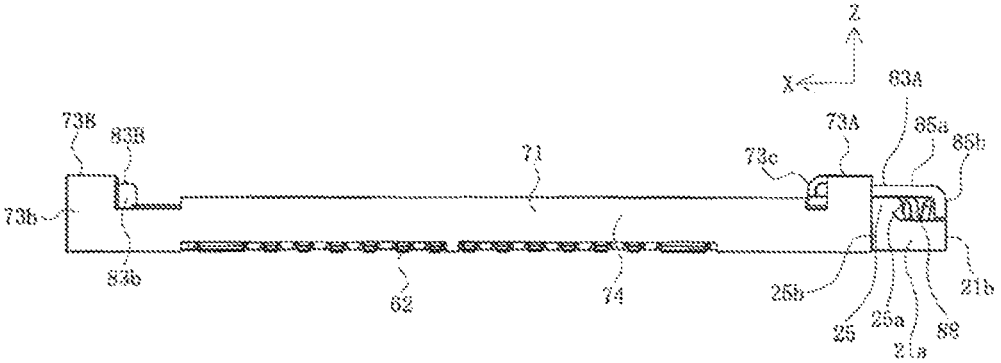

FIGS. 1A and 1B are perspective views of a first connector according to a first embodiment, and FIGS. 2A and 2B are two-surface views of the first connector according to the first embodiment. Note that, FIG. 1A is a view from a mating face side, and FIG. 1B is a view from a mounting face side. FIG. 2A is a top view, and FIG. 2B is a side view.

That figure shows a first connector 1, which is a connector of the present embodiment and serves as a first one of a pair of board to board connectors. The pair of such connectors is referred to as a connector assembly. The first connector 1 is a surface mount type connector, and is mounted on a surface of a first substrate (not illustrated in the drawings and serving as a mounting member). The first connector 1 is mated to a second connector 101 that serves as a counterpart connector (to be described later). In addition, the second connector 101 is a second one of the pair of board to board connectors, and is a surface mount type connector mounted on a surface of a second substrate (not illustrated in the drawings and serving as a mounting member).

Note that while the first connector 1 and the second connector 101, which are included in the connector assembly of the present embodiment, are preferably used for electrically connecting the first substrate and the second substrate serving as substrates. The first and the second connectors 1 and 101 may also be used to electrically connect other members. Examples of the first substrate and the second substrate include printed circuit boards, flexible flat cables (FFC), flexible printed circuit boards (FPC), etc. used in electronic equipment and the like devices. Any type of substrates may be used as the first substrate and the second substrate.

Furthermore, expressions for indicating directions such as up, down, left, right, front, and back, used to describe the operations and configurations of the parts of the first connector 1 and those of the second connector 101 in the present embodiment are not absolute but rather relative directions. In addition, such expressions are appropriate as long as the parts of the first connector 1 and those of the second connector 101 are in the postures illustrated in the figures, but they are not when the postures of the illustrated parts change. In the event of such changes, the directions should be interpreted differently in accordance with the changes.

Furthermore, the first connector 1 has a first housing 11 as a connector body, which is integrally formed of an insulating material such as a synthetic resin. As is illustrated in the figure, the first housing 11 is a substantially rectangular body having a substantially rectangular thick plate shape. A substantially rectangular recess 12 is formed on the side into which the second connector 101 is fitted, that is, on the mating face 11*a* side (i.e., on the positive Z-axis direction side). The periphery of the recess 12 is enclosed, and the recess 12 is mated with a second housing 111(to be described later). The first connector 1 has, for example, a lengthwise dimension of approximately 10 mm, a widthwise dimension of approximately 2 mm, and a thickness-direction dimension of approximately 1 mm, but the dimensions may be altered as appropriate when necessary. In addition, in the recess 12, a first projection 13 is formed integrally with the first housing 11. The first projection serves as an island part that is to be mated with a recessed groove part 113 (to be described later). On the two sides in the Y-axis direction of the first projection 13, side wall parts 14 extending in parallel to the first projection 13 are formed integrally with the first housing 11.

In this case, the first projection 13 and the side wall parts 14 protrude upwards (i.e., in the positive Z-axis direction) from the bottom face of the recess 12, and extend in the longitudinal direction (in the X-axis direction) of the first housing 11. Recessed groove parts 12*a* are thus formed, as parts of the recess 12, on the two sides of the first projection 13. The recessed groove parts 12*a* are elongated recesses extending in the longitudinal direction of the first housing 11, First-terminal-storing inner cavities 15*a*, each of which has a recessed-groove shape, are formed in the side surfaces on the two sides of the first projection 13.In addition, first-terminal-storing outer cavities 15*b*, each of which has a recessed-groove shape, are formed in the inner side surfaces of the side wall parts 14. Each of the first-terminal-storing inner cavities 15*a* and the corresponding one of the first-terminal-storing outer cavities 15*b* are linked together by the bottom surfaces of the recessed groove parts 12*a* and thus integrated with each other. Hence, to describe the first-terminal-storing inner cavities 15*a* and the first-terminal-storing outer cavities 15*b* in a collective manner, the first-terminal-storing inner cavities 15*a* and the first-terminal-storing outer cavities 15*b* are simply referred to as the first-terminal-storing cavities 15.

In the present embodiment, the first-terminal-storing cavities 15 are formed side by side in the longitudinal direction of first housing 11 on the two sides, in the width direction (i.e., in the Y-axis direction), of the first housing 11. Specifically, a plurality of the first-terminal-storing cavities 15 are formed at a predetermined pitch on each of the two sides of the first projection 13. A plurality of the first terminals 61, each of which is stored in the corresponding one of the first-terminal-storing cavities 15 and mounted to the first housing 11, are also disposed at a similar pitch on each of the two sides of the first projection 13.

In addition, the first terminals 61 each of which is stored in the corresponding one of the first-terminal-storing cavities 15 are classified into two types: wider first terminals 61A; and narrower first terminals 61B. Hence, the first-terminal-storing cavities 15 are also classified into two types: wider first-terminal-storing cavities 15A, which store the wider first terminals 61A; and narrower first-terminal-storing cavities 15B, which store the narrower first terminals 61B. The wider first-terminal-storing cavities 15A are formed at each of the two end sides, in the longitudinal direction, of each row located on the two sides, in the width direction, of first housing 11. The narrower first-terminal-storing cavities 15B are formed in each row between the two wider first-terminal-storing cavities 15A located at their respective ends of the row. Note that, because the wider first-terminal-storing cavities 15A and the narrower first-terminal-storing cavities 15B have a similar configuration aside from the widthwise dimension (i.e., the dimension measured in the X-axis direction), the wider first-terminal-storing cavities 15A and the narrower first-terminal-storing cavities 15B are collectively referred to as the first-terminal-storing cavities 15. In addition, because the wider first terminals 61A and the narrower first terminals 61B have a similar configuration aside from the widthwise dimension (i.e., the dimension measured in the X-axis direction), the wider first terminals 61A and the narrower first terminals 61B are collectively referred to as the first terminals 61.

The first terminal 61 is a member integrally formed by carrying out processing such as punching and bending on a conductive metal plate. The first terminal 61 includes a to-be-held part (not illustrated), a tail part 62 connected to the bottom end of the to-be-held part, an upper connection part 67 connected to the top end of to-be-held part, a second contact part 66 formed in the vicinity of the inward end of the upper connection part 67, a lower connection part 64 connected to the second contact part 66, and a first contact part 65 formed in the vicinity of free end of the lower connection part 64.

The to-be-held part extends in the up-down direction (i.e., in the Z-axis direction), that is, in the thickness direction of the first housing 11. In addition, the to-be-held part is the portion that is to be fitted into and held in the corresponding first-terminal-storing outer cavity 15*b* . In addition, the tail part 62 is bent and connected to the to-be-held part, extends in the left-right direction (i.e., in the Y-axis direction), that is, outward in the width direction of the first housing 11, and is connected, by soldering or the like method, to a connection pad linked to a conductive trace of the first substrate. Moreover, the upper connection part 67 is bent and connected to the to-be-held part, and extends inward in the width direction of the first housing 11.

On the inner end of the upper connection part 67, the second contact part 66 is formed. The second contact part 66 is bent downward (i.e., in the negative Z-axis direction) and is curved so as to protrude inward in the width direction of the first housing 11. In addition, the lower connection part 64 is a portion connected to the bottom end of the second contact part 66 and having a U-shaped side face. In the vicinity of the free end of the lower connection part 64, that is, in the vicinity of the top end on the inner side of the lower connection part 64, the first contact part 65 is formed. The first contact part 65 is bent in a U-shape and is curved so as to protrude outward in the width direction of the first housing 11.

Each of the first terminal 61 is fitted into the corresponding first-terminal-storing cavity 15, from the side of a mounting face 11*b*, which is the downside surface (i.e., the surface facing in the negative Z-axis direction) of the first housing 11. Then, the first terminal 61 is fixed to the first housing 11 as the to-be-held part is clamped from both sides by the side walls of the first-terminal-storing outer cavity 15*b* formed in the inner side surface of the side wall part 14. In this state, that is, in a state where the first terminal 61 is mounted to the first housing 11, the first contact part 65 and the second contact part 66 are positioned on both the left and right sides of the recessed groove part 12*a* and face each other.

Note that, because the first terminal 61 is a member integrally formed by carrying out a processing on a metal plate, the first terminal 61 is elastic to a certain degree. In addition, as is obvious from the shape of the first terminal 61, the distance between the first contact part 65 and the second contact part 66 which face each other, is elastically variable. Specifically, when a second terminal 161 (to be described later), of the second connector 101 is inserted between the first contact part 65 and the second contact part 66, the distance between the first contact part 65 and the second contact part 66 elastically expands.

Moreover, first protruding end parts 21A, 21B, which are mating-guide parts, are disposed on the two ends, in the longitudinal direction of, the first housing 11. In the following description, the first protruding end part positioned on the rear end side (i.e., at the end in the negative X-axis direction) of the first housing 11 is referred to as the first protruding end part 21A, and the first protruding end part positioned on the front end side (i.e., at the end in the positive X-axis direction) of the first housing 11 is referred to as the first protruding end part 21B. The first protruding end part 21A and the first protruding end part 21B are collectively referred to as the first protruding end parts 21A, 21B. On the first protruding end part 21A, a mating recess 22A is formed as a part of the recess 12, and, on the first protruding end part 21B, a mating recess 22B is formed as a part of the recess 12. The mating recess 22A is connected to the rear end, in the longitudinal direction (i.e., the end in the negative X-axis direction), of each recessed groove part 12*a*, and the mating recess 22B is connected to the front end, in the longitudinal direction (i.e., the end in the positive X-axis direction), of each recessed groove part 12*a*. The mating recess 22A and of the mating recess 22B are substantially rectangular recess and are collectively referred to as the mating recesses 22. A second protruding end part 122 (to be described later) of the second connector 101 is inserted into the mating recess 22 in a state where the first connector 1 and the second connector 101 are mated together.

Note that the first protruding end part 21A includes: an extension part 21*a* extending rearwards (i.e., in the negative X-axis direction); a bulging-out part 25 formed on the extension part 21*a;* and a spring-accommodating recessed part 26 (to be described later) configured to accommodate a spring 88 serving as a biasing member. Note that the spring 88 may be a spring member of any kind. For instance, a leaf spring may be used for this purpose, but in the following description the spring 88 is assumed to be a coil spring. The upper surface of the extension part 21*a* is positioned below (on the negative Z-axis side) the mating face 11*a* of the first housing 11, whereas the upper surface of the bulging-out part 25 is substantially flush with the mating face 11*a*. In addition, a rear-end face 21*b* of the extension part 21*a* is located at a further rearward position than a rear-end face 25*a* of the bulging-out part 25. The spring-accommodating recessed part 26 is a groove-shaped part with an open upper side and is formed to extend in the longitudinal direction of the first housing 11 from the extension part 21*a* to the bulging-out part 25. Once the spring 88 is accommodated in the spring-accommodating recessed part 26, the spring 88 is exposed over the extension part 21*a* in an area located further rearwards than the rear-end face 25*a* of the bulging-out part 25.

A slidable locking member 81, serving as a slider, is slidably attached to the first housing 11. In that state, the slidable locking member 81 is slidable in the longitudinal direction of the first housing 11 (i.e., in the X-axis direction) between the locked position and the unlocked position. The slidable locking member 81 is, for instance, a member integrally formed by carrying out processing such as punching and bending on a metal plate, and is a member with an overall shape of a rectangular frame. In addition, the slidable locking member 81 has: a pair of belt-shaped side frames 84 extending in the longitudinal direction of the first housing 11; and a pair of end-part-coupling frames 83, each of which is configured to couple either the front ends of the side frames 84 with each other or the rear end thereof with each other. Each of the side frames 84 is disposed so as to be slidable along the outer side surface of the corresponding one of the left-hand-side and right-hand-side side wall parts 14 of the first housing 11. Each of the end-part-coupling frames 83 is disposed so as to be slidable along the outer surface of the corresponding one of the front-side and rear-side first protruding end parts 21A, 21B of the first housing 11. Note that the first housing 11 does not have to be made of a metal material, but may be made of any other material such as a synthetic resin as long as the material to be used has a sufficient strength.

The end-part-coupling frame 83 located on the rear-end side of the first housing 11 is referred to as a first end-part-coupling frame 83A, whereas the end-part-coupling frame 83 located on the front-end side of the first housing 11 is referred to as a second end-part-coupling frame 83B. The first end-part-coupling frame 83A and the second end-part-coupling frame 83B are collectively referred to as the end-part-coupling frames 83. When viewed from the the X-axis direction, each of the end-part-coupling frames 83 has a substantially gate-like shape and is attached so as to bridge the outer peripheral portions of the first protruding end parts 21A, 21B. Each of the end-part-coupling frames 83 thus attached is slidable in the longitudinal direction of the first housing 11. Specifically, each of the end-part-coupling frames 83 has: a right-and-left pair of leg parts 83*b*, which extend upwards (i.e., in the positive Z-axis direction) from the front end or rear end of the corresponding right-hand-side and left-hand-side side frames 84; and a coupling beam part 83*a*, which extend in the width direction of the first housing 11 (i.e., in the Y-axis direction) and which is configured to couple the top ends of the right and left leg parts 83*b*.

Note that the first end-part-coupling frame 83A has an operation part 85, which extends rearwards (i.e., in the negative X-axis direction) from the rear end of the coupling beam part 83*a*. The operation part 85 includes: a flat-plate-shaped top plate part 85*a,* which extends in the X-Y directions so as to cover the bulging-out part 25 in the first protruding end part 21A; and a rear plate part 85*b,* which extends downwards (i.e., in the negative Z-axis direction)

from the rear end of the top plate part 85*a*. In a state where the slidable locking member 81 is attached to the first housing 11, the top plate part 85*a* covers, from above, the spring 88 accommodated in the spring-accommodating recessed part 26. In that state, the rear plate part 85*b* is in contact with the rear end of the spring 88 and is biased by a rearward biasing force exerted by the spring 88. Note that even if the rear plate part 85*b* is biased rearwards by the spring 88 when the rear ends of the leg parts 83*b* is in contact with the front-end face 25*b* of the bulging-out part 25, the first end-part-coupling frame 83A will not be displaced further rearwards than the locked position illustrated in FIGS. 1A-B and FIGS. 2A-B. To put it differently, the first end-part-coupling frame 83A is stopped by the biasing force of the spring 88 so that the rear face of the rear plate part 85*b* is substantially flush with the rear-end face 21*b* of the extension part 21*a*.

In addition, in the right-hand-side and left-hand-side side frames 84, locking tabs 84*a* are formed at positions facing the mating recess 22A. Each of the locking tabs 84*a* extends towards the center, in the width direction of the first housing 11 from the corresponding one of the above-described positions. Each of the locking tabs 84*a* are formed by cutting a portion of the corresponding side frame 84 near the top end thereof and by raising up the cut portion. The top-end face of the locking tab 84*a* is flush with the top-end face of the side frame 84. The locking tabs 84*a* are perpendicular to the side frames 84 and protrude towards the inside of the mating recess 22A. The locking tabs 84*a* functions as rear-side locking parts operable to lock to-be-locked parts 184 that a reinforcing metal fitting 181A of the second connector 101 (to be described later) has.

Note that the first end-part-coupling frames 83B have no member corresponding to the operation part 85. A rear-end edge part 83*c* of the coupling beam part 83*a*, however, is configured to cover, from above, the front end of the mating recess 22B, and functions as front-side locking part operable to lock a to-be-locked parts 184 that a reinforcing metal fitting 181B (to be described later) of the second connector 101 has.

In addition, a shell 71 is fixedly attached to the first housing 11 so as to cover the slidable locking member 81 from outside. The shell 71 is, for instance, a member integrally formed by carrying out processing such as punching and bending on a metal plate, and is a member with an overall shape of a rectangular frame. In addition, the shell 71 has: a pair of belt-shaped side frames 74 extending in the longitudinal direction of the first housing 11; and a pair of end-part-coupling frames 73, each of which is configured to couple either the front ends of the side frames 74 with each other or the rear end thereof with each other. Each of the side frames 74 are disposed so as to cover, from outside, the corresponding one of the right side frame 84 and the left side frame 84 of the slidable locking member 81. In addition, the end-part-coupling frames 73 are disposed so as to cover at least a portion of the corresponding one of the front-side end-part-coupling frame 83 and the rear-side end-part-coupling frame 83 of the slidable locking member 81.

The end-part-coupling frame 73 located on the rear-end side of the first housing 11 is referred to as a first end-part-coupling frame 73A, whereas the end-part-coupling frame 73 located on the front-end side of the first housing 11 is referred to as a second end-part-coupling frame 73B. The first end-part-coupling frame 73A and the second end-part-coupling frame 73B are collectively referred to as the end-part-coupling frames 73. When viewed from the X-axis direction, each of the end-part-coupling frames 73 has a substantially gate-like shape, and is fixedly attached to the first housing 11 so as to bridge the outer peripheral portions of the end-part-coupling frames 83 of the slidable locking member 81. Specifically, each of the end-part-coupling frames 73 has: a right-and-left pair of leg parts 73*b*, which extend upwards from the front end or rear end of the corresponding right-hand-side and left-hand-side side frames 74; and a coupling beam part 73*a*, which extend in the width direction of the first housing 11 and which is configured to couple the top ends of the right and left leg parts 73*b*. The coupling beam part 73*a* is located above the coupling beam part 83*a* in each of the end-part-coupling frames 83 of the slidable locking member 81, and each of the right-hand-side leg part 73*b* and the left-hand-side leg part 73*b* is located on the outer side of the corresponding one of the right-hand-side leg part 83*b* and the left-hand-side leg part 83*b* in the end-part-coupling frames 83. In a state where the shell 71 is attached to the first housing 11, the rear end of each of the leg parts 73*b* of the first end-part-coupling frame 73A is in contact with the front-end face 25*b* of the bulging-out part 25 of the first protruding end part 21A, and the front end of each of the leg parts 73*b* of the second end-part-coupling frame 73B is substantially flush with the front-end face of the first protruding end part 21B.

Note that the first end-part-coupling frame 73A has a stopper part 73*c*, which extends forwards (i.e., in the positive X-axis direction) from the front end of the coupling beam part 73*a* and which is curved so as to direct the distal end of the stopper part 73*c* downwards. In a state where the first end-part-coupling frame 83A is stopped by the biasing force of the spring 88 so that the rear face of the rear plate part 85*b* is substantially flush with the rear-end face 21*b* of the extension part 21*a*, the front end of the coupling beam part 83*a* of the first end-part-coupling frame 83A is spaced apart from the stopper part 73*c* and is located at a further rear-side position than the stopper part 73*c*. When the first end-part-coupling frame 83A, together with the other parts of the slidable locking member 81, is moved forwards against the biasing force of the spring 88 by, for instance, an operation of the operator, the front end of the coupling beam part 83*a* is brought into contact with the stopper part 73*c* and thus the first end-part-coupling frame 83A is stopped together with the other parts of the slidable locking member 81. As such, the stopper part 73*c* of the first end-part-coupling frames 73A functions as a positioning part that is operable to stop the forward sliding movement of the slidable locking member 81 at a predetermined unlocked position.

At the top end of each of the side frames 74, an eaves part 74*a* is formed to protrude towards the center, in the width direction, of the first housing 11. The eaves part 74*a* covers, from above, the top end of the corresponding one of the side frames 84 in the slidable locking member 81. A plurality of connection projections 76, which protrude downwards, are formed at several positions on the bottom end of each of the side frames 74. Note that the bottom end of each of the connection projections 76 is exposed on the mounting face 11*b* of the first housing 11 and is connected by soldering or the like method to a connection pad formed the corresponding surface of the first substrate. In this way, the shell 71 is fixed to the surface of the first substrate together with the first housing 11.

Next, the configuration of the second connector 101 will be described.

Figure 3B:
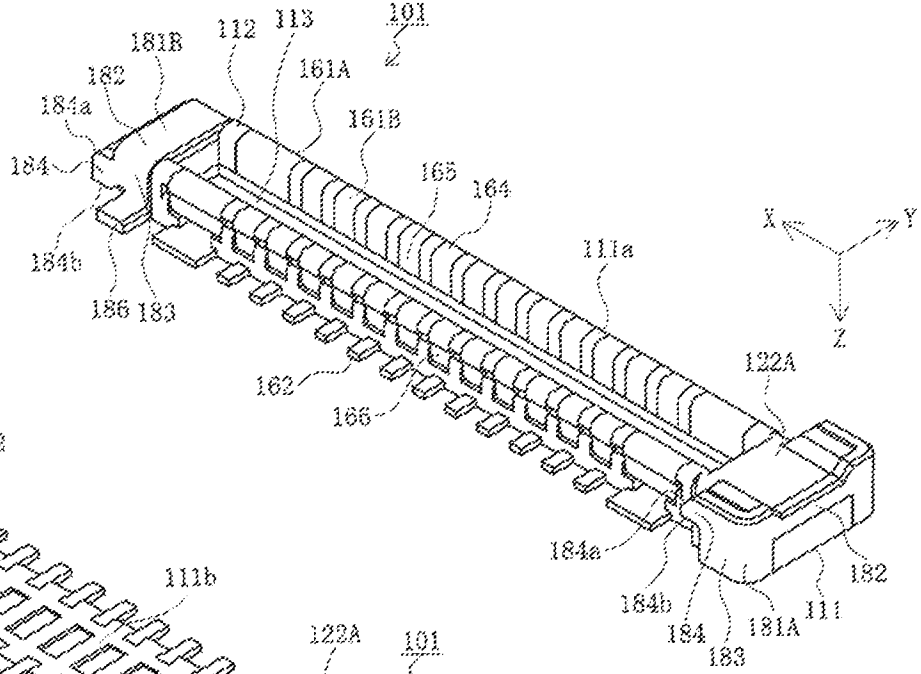
FIGS. 3A and 3B show perspective views of a second connector according to the first embodiment.
Figure 3A:
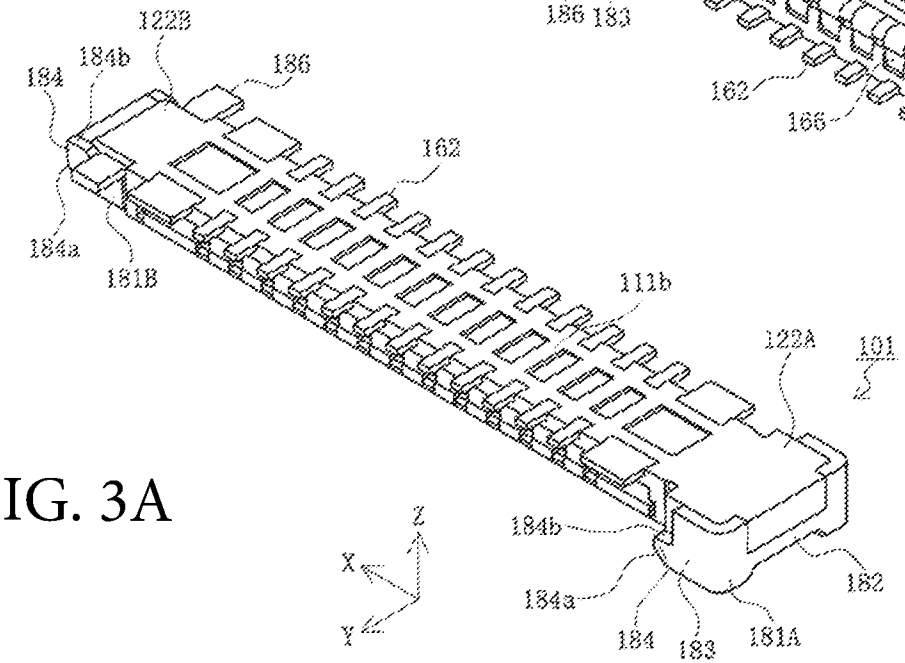
Figure 4A:
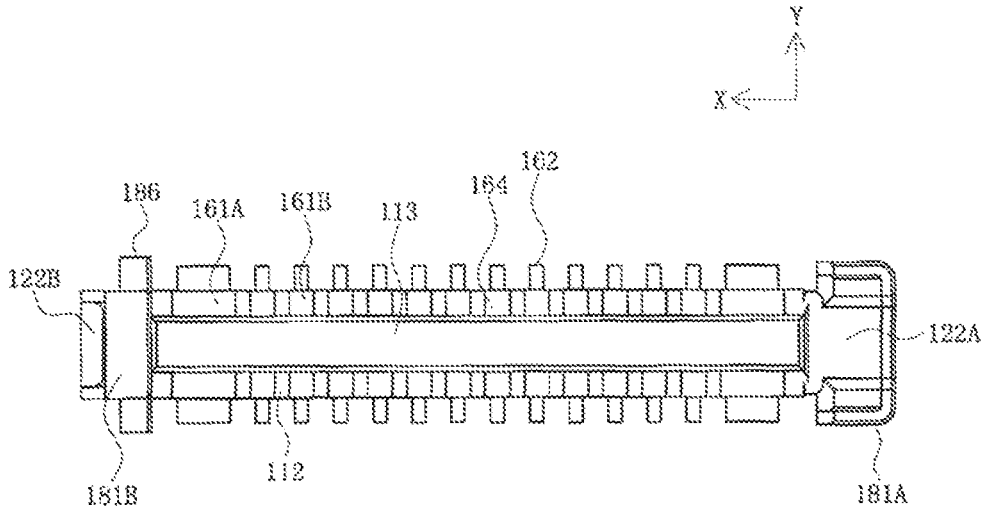
FIGS. 4A and 4B are two-surface views of the second connector according to the first embodiment.
Figure 4B:
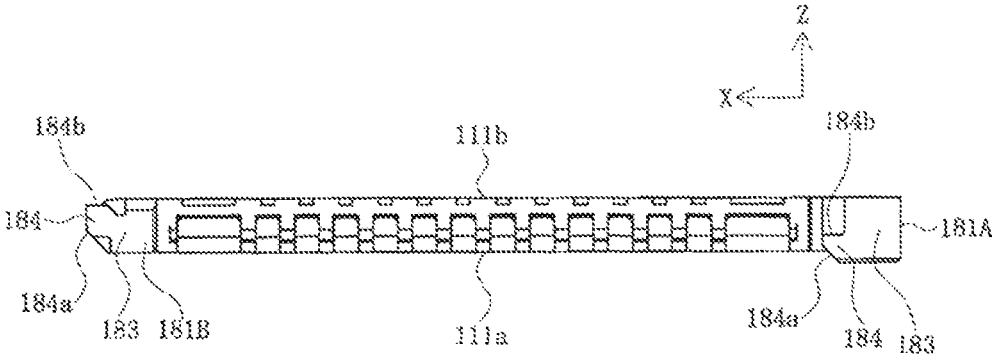

FIGS. 3A and 3B are perspective views of the second connector according to the first embodiment, and FIGS. 4A and 4B are two-surface views of the second connector according to the first embodiment. Note that, FIG. 3A is a view from the mounting face side and FIG. 3B is a view from the mating face side. In FIG. 4A is a top view and FIG. 4B is a side view.

The second connector 101 has the second housing 111 as a counterpart connector body, which is integrally formed of an insulating material such as a synthetic resin. As is illustrated in the figure, the second housing 111 is a substantially rectangular body having a shape of a substantially rectangular thick plate. An elongated recessed groove part 113 and second projections 112 are integrally formed on a side of the second housing 111, the side being the one that is fitted into the first connector 1, that is, the side where the mating face 111*a* is located on (i.e., the negative Z-axis direction side). The elongated recessed groove part 113 extends in the longitudinal direction (i.e., in the X-axis direction) of the second housing 111. The second projections 112 are elongated projections extending in the longitudinal direction of the second housing 111 and defining the outer side of recessed groove part 113. The second projections 112 are formed along the two sides of recessed groove part 113 and also along the two sides of the second housing 111. In addition, second terminals 161, serving as counterpart terminals, are disposed in each of the second projections 112. As is illustrated in the figure, the recessed groove part 113 has a side closed by a bottom part. The closed side is the one that is to be mounted on the second substrate, that is, the side that a mounting face 111*b* is located on (i.e., on the positive Z-axis direction side).

Note that the second terminals 161 are classified into two different kinds of second terminals: firstly, wider second terminals 161A; and secondly, narrower second terminals 161B. The wider second terminals 161A are formed at each of the two end sides in the longitudinal direction of each row on the two sides, in the width direction, of the second housing 111. The narrower second terminals 161B are formed in each row between the two wider second terminals 161A located at their respective ends of the row. Note that because the wider second terminals 161A and the narrower second terminals 161B have a similar configuration aside from the widthwise dimension (i.e., the dimension measured in the X-axis direction), the wider second terminals 161A and the narrower second terminals 161B are collectively referred to as the second terminals 161.

The second terminals 161 are a member integrally formed by carrying out processing such as punching and bending on a conductive metal plate. Each of second terminals 161 includes: a main body part (not illustrated), a tail part 162 connected to the bottom end of the main body part, a first contact part 165 connected to the top end of the main body part, a connection part 164 connected to the top end of the first contact part 165, and a second contact part 166 connected to the outer end of the connection part 164.

The main body part is a portion that is surrounded and held by the second housing 111. In addition, the tail part 162 is connected to the bottom end of the main body part, the bottom end extending in the right-left direction of the main body part, that is, in the width direction of the second housing 111. The tail part 162 extends toward the outside of the second housing 111 and is connected by soldering or the like method to a connection pad linked to a conductive trace of the second substrate.

The second terminals 161 are integrated into the second housing 111 by a formation method referred to as the over-molding method or the insert-molding method. Specifically, the second housing 111 is molded by filling, with an insulating material, the cavity in a mold with the second terminals 161 set therein beforehand. Hence, the second terminals 161 are attached integrally to the second housing 111 with the main body part buried in the second housing 111 and with the surfaces of the first contact part 165, of the connection part 164, and of the second contact part 166 exposed on each side face and the mating face 111*a* of the second projection 112. Note that the second terminals 161 are disposed on both the right-hand side and on the left-hand side. The number of the second terminals 161 are the same as that of the first terminals 61 of the first connector 1, and are placed at the same intervals as those for the first terminals 61.

The second protruding end parts 122, which are a counterpart mating-guide parts, are disposed on their respective ends, in the longitudinal direction, of the second housing 111. In the following description, the second protruding end part 122 positioned on the rear end side (i.e., at the end in the negative X-axis direction) of the second housing 111 is referred to as the second protruding end part 122A, and the second protruding end part 122 positioned on the front end side (i.e., at the end in the positive X-axis direction) of the second housing 111 is referred to as the second protruding end part 122B. The second protruding end part 122A and the second protruding end part 122B are collectively referred to as the second protruding end parts 122. The second protruding end part 122 is a thick member extending in the width direction (in the Y-axis direction) of the second housing 111 and having the two ends thereof connected to the two ends, in the longitudinal direction, of each of the second projections 112. In addition, in a state where the first connector 1 and the second connector 101 are mated together, the second protruding end parts 122 function as insertion projections configured to be inserted into the mating recesses 22 of the first protruding end parts 21A, 21B included in the first connector 1.

In addition, reinforcing metal fittings 181, serving as counterpart locking members, are attached to the second protruding end parts 122. In the following description, the reinforcing metal fitting 181 attached to the second protruding end part 122A is referred to as a reinforcing metal fitting 181A, whereas the reinforcing metal fitting 181 attached to the second protruding end part 122B is referred to as a reinforcing metal fitting 181B. The reinforcing metal fitting 181A and the reinforcing metal fitting 181B are collectively referred to as the reinforcing metal fittings 181. Note that like the second terminals 161, the reinforcing metal fittings 181 are integrated into the second housing 111 by a formation method referred to as the over-molding method or the insert-molding method.

Each of the reinforcing metal fittings 181 is a member integrally formed by carrying out processing such as punching and bending on a metal plate. Each of the reinforcing metal fittings 181 includes a main body part 182 extending in the width direction of the second housing 111, a side-covering part 183 connected to both the left-hand side end and the right-hand side end of the main body part 182, and the to-be-locked part 184 connected to a side edge of the side-covering part 183.

In the reinforcing metal fitting 181A, the main body part 182 is a belt-shaped member extending along the rear-end face of the second protruding end part 122A in the width direction of the second housing 111. The main body part 182 is attached so as to cover a portion of the rear-end face of the second protruding end part 122. The side-covering part 183 is attached so as to cover the most portion of the side surfaces of the second protruding end part 122A. The top end (the end located in the negative Z-axis direction) of the side-covering part 183 is substantially flush with the top-end face of the second protruding end part 122A whereas the bottom end (the end located in the positive Z-axis direction) of the side-covering part 183 is substantially flush with the bottom-end face of the second protruding end part 122A and the mounting face 111*b* of the second housing 111. From a position near the top end in the front end of the side-covering part 183, the to-be-locked part 184 extends forwards. At an end part of the to-be-locked part 184 located on the mating face 111*a* side, that is, the top end of the to-be-locked part 184, a sloping part 184*a* is formed so that the portion thereof that is located at further front position becomes closer to the mounting face 111*b*. In addition, at an end part of the to-be-locked part 184 located on the mounting face 111*b* side, that is, the bottom end of the to-be-locked part 184, an engagement part 184*b* is formed so as to extend in parallel to the mounting face 111*b* and in the front-rear direction. The to-be-locked parts 184 function as second rear-side locking parts operable to be locked by the locking tabs 84*a* that the slidable locking member 81 of the first connector 1 has. Note that the bottom end of the side-covering part 183 is connected by soldering or the like method to a connection pad formed on the corresponding surface of the second substrate.

In addition, the main body part 182 of the reinforcing metal fitting 181B is a belt-shaped member extending along the top face of the second protruding end part 122B (the surface located on the negative Z-axis direction side) in the width direction of the second housing 111. The side-covering part 183 is attached so as to cover the most portion of the side surfaces of the second protruding end part 122B. To the bottom end (the end located in the positive Z-axis direction) of the side-covering part 183, connection pieces 186 are connected so as to extend outwards in the width direction of the second housing 111 (in the Y-axis direction). From the front end of each of the side-covering parts 183, the to-be-locked parts 184 extend forwards. At an end part of the to-be-locked part 184 located on the mating face 111*a* side, that is, the top end of the to-be-locked part 184, a sloping part 184*a* is formed so that the portion thereof that is located at further front position becomes closer to the mounting face 111*b*. In addition, at an end part of the to-be-locked part 184 located on the mounting face 111*b* side, that is, the bottom end of the to-be-locked part 184, an engagement part 184*b* is formed so as to extend in parallel to the mounting face 111*b* and in the front-rear direction. The to-be-locked parts 184 are locked by the rear-end edge part 83*c* of the coupling beam part 83*a* that the first end-part-coupling frames 83B of the slidable locking member 81 of the first connector 1 has. Note that the bottom face of each of the connection pieces 186 is connected by soldering or the like method to a connection pad formed on the corresponding surface of the second substrate.

The operation for mating first connector 1 and second connector 101 having the above-mentioned configuration will be described next.

Figure 5A:
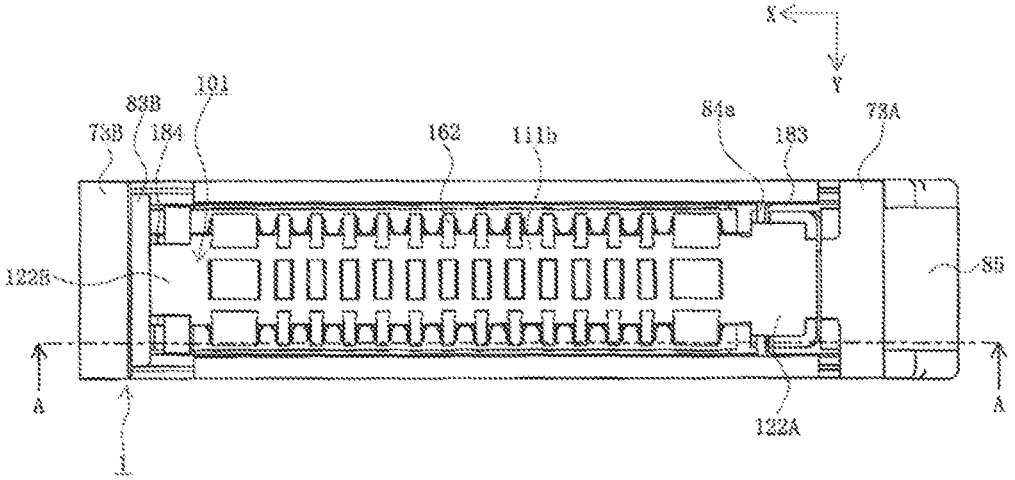
FIGS. 5A and 5B are two-surface views illustrating the state in which the first connector and the second connector according to the first embodiment are mated.
Figure 5B:
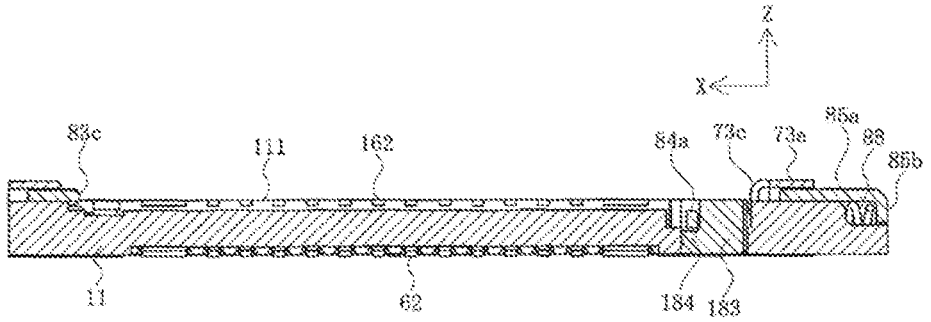
Figure 6:
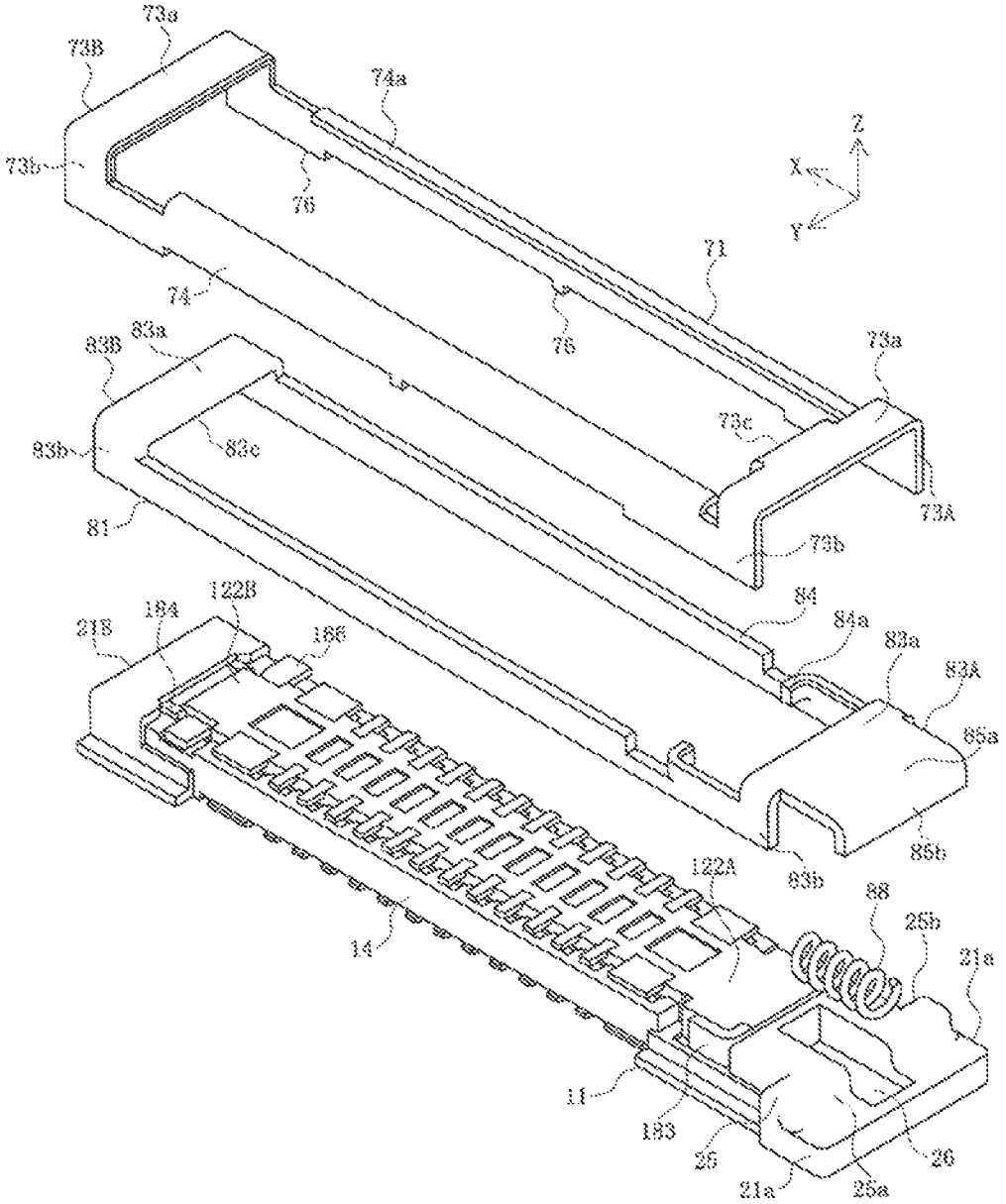
FIG. 6 is an exploded view illustrating a state in which the first connector and the second connector according to the first embodiment are mated together.
Figure 7:
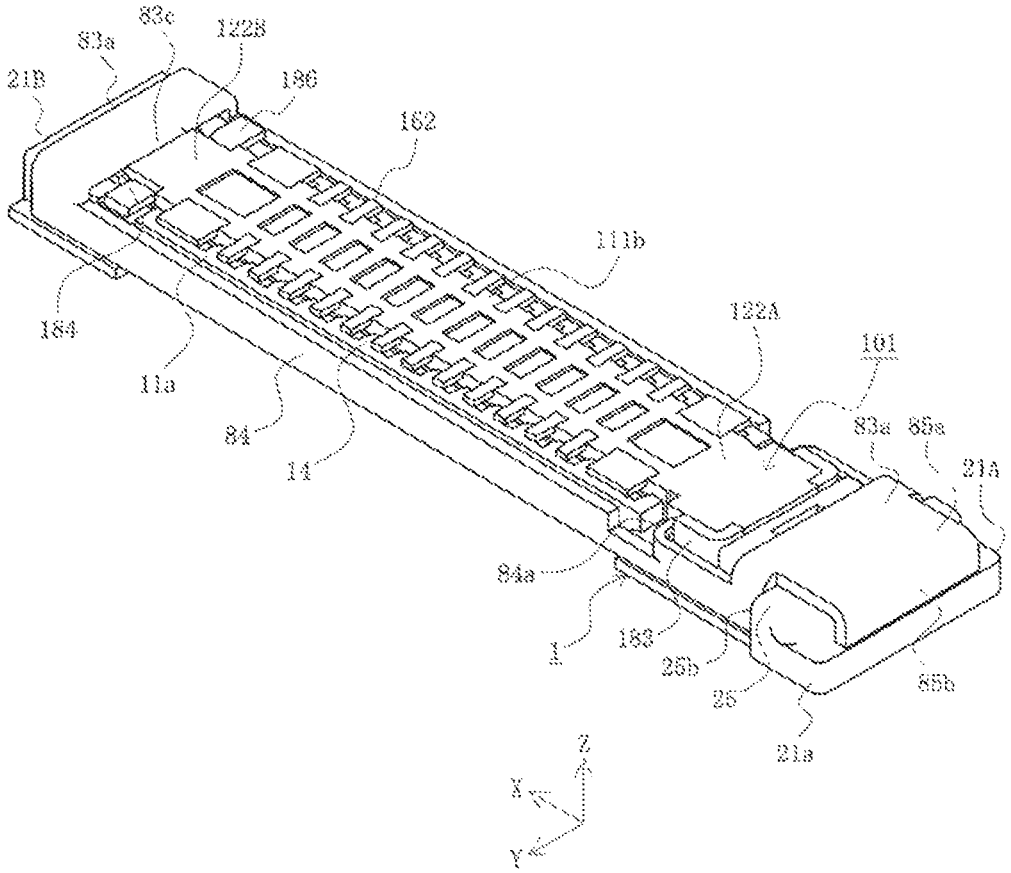
FIG. 7 is a perspective view illustrating, with the shell removed, a state in which the first connector and the second connector according to the first embodiment are mated together.

FIGS. 5A and 5B are two-surface views illustrating the state in which the first connector and the second connector according to the first embodiment are mated. FIG. 6 is an exploded view illustrating a state in which the first connector and the second connector according to the first embodiment are mated together. FIG. 7 is a perspective view illustrating, with the shell removed, a state in which the first connector and the second connector according to the first embodiment are mated together. Note that FIG. 5A is a top view, and FIG. 5B is a cross-sectional view along the line A-A seen from arrows A in FIG. 5A.

The following description assumes that the first connector 1 is mounted on the surface of the first substrate by: connecting the tail parts 62 of the first terminals 61 to the corresponding connection pads coupled to a conductive trace of the first substrate (not illustrated) by soldering or the like method; and connecting the connection projections 76 of the shell 71 to the corresponding connection pads of the first substrate by soldering or the like method. Likewise, the second connector 101 is mounted on the surface of the second substrate by: connecting the tail parts 162 of the second terminals 161 to the corresponding connection pads coupled to a conductive trace of the second substrate (not illustrated) by soldering or the like method; and the bottom end of the side-covering part 183 of the reinforcing metal fitting 181A and the bottom faces of the connection pieces 186 of the reinforcing metal fitting 181B to the corresponding connection pads of the second substrate by soldering or the like method.

Firstly, an operator places the first connector 1 and the second connector 101 so that the mating face 11*a* of the first housing 11 of the first connector 1 and the mating face 111*a* of the second housing 111 of the second connector 101 face each other. Then the operator aligns the first connector 1 and the second connector 101 until the positions of the second projections 112 on the second connector 101 are aligned with the positions of the corresponding recessed groove parts 12*a* on the first connector 1 and the positions of the second protruding end parts 122A and 122B on the second connector 101 are aligned with the positions of the corresponding mating recesses 22A and 22B on the first connector 1.

Then, the operator moves the first connector 1 and/or the second connector 101 thus aligned with each other so as to make them closer to each other, that is, move them in the mating direction (in their respective Z-axis directions). The second protruding end parts 122A and 122B on the second connector 101 are thus inserted respectively in the mating recesses 22A and 22B on the first connector 1.

Once the insertion is complete, the sloping parts 184*a* formed in the to-be-locked parts 184 of the reinforcing metal fitting 181A on the second connector 101 are in contact with the rear ends of the locking tabs 84*a* that the slidable locking member 81 on the first connector 1 has. At the same time, the sloping parts 184*a* formed in the to-be-locked parts 184 of the reinforcing metal fitting 181B on the second connector 101 are in contact with the rear-end edge part 83*c* of the coupling beam part 83*a* that the second end-part-coupling frame 83B of the slidable locking member 81 on the first connector 1 has. Then, in the above-described state, the operator applies, to the first connector 1 and/or the second connector 101, a force that moves the first connector 1 and/or the second connector 101 in the mating direction(s). As a consequence, the locking tab 84*a* of the slidable locking member 81 receives a forward force (a force directed in the positive X-axis direction) from the sloping parts 184*a* formed in the to-be-locked parts 184 of the reinforcing metal fitting 181A. At the same time, the rear-end edge part 83*c* of the coupling beam part 83*a* that the second end-part-coupling frame 83B of the slidable locking member 81 has receives a forward force from the sloping parts 184*a* formed in the to-be-locked parts 184 of the reinforcing metal fitting 181B. The slidable locking member 81 is thus displaced by sliding forwards against the biasing force exerted by the spring 88 accommodated in the spring-accommodating recessed part 26 formed in the first protruding end part 21A of the first housing 11. In addition, the locking tabs 84*a* and the rear-end edge part 83*c* of the coupling beam part 83*a* also slide forwards to make the slidable locking member 81 reach the unlocked position. Consequently, the to-be-locked parts 184 of the reinforcing metal fitting 181A and the to-be-locked parts 184 of the reinforcing metal fitting 181B is displaced downwards i.e., towards the mounting face 11*b* of the first housing 11 (in the negative Z-axis direction) beyond the locking tabs 84*a* and the rear-end edge part 83*c* of the coupling beam part 83*a*.

Then, once the to-be-locked parts 184 of the reinforcing metal fitting 181A and the to-be-locked parts 184 of the reinforcing metal fitting 181B have reached a level below that of the locking tabs 84*a* and the rear-end edge part 83*c* of the coupling beam part 83*a*, the forward forces are released. The slidable locking member 81 is thus displaced by sliding rearwards due to the biasing force of the spring 88, and thus returns to the original, locked position. Consequently, the locking tabs 84*a* and the rear-end edge part 83*c* of the coupling beam part 83*a* engage, from above, with the engagement parts 184*b* formed in the to-be-locked parts 184 of the reinforcing metal fitting 181A and the engagement parts 184*b* formed in the to-be-locked parts 184 of the reinforcing metal fitting 181B. The to-be-locked parts 184 of the reinforcing metal fittings 181 are thus locked by the slidable locking member 81, which causes the first connector 1 and the second connector 101 to be locked with each other. Note that the slidable locking member 81 stops its rearward displacement once the rear ends of the leg parts 83*b* of the first end-part-coupling frame 83A are brought into contact with the front-end face 25*b* of the bulging-out part 25.

In this way, as illustrated in FIGS. 5A-B to FIG. 7, once the first connector 1 and the second connector 101 are fully mated together, each of the second terminals 161 of the second connector 101 is inserted in the interstice between the first contact part 65 and the second contact part 66 of the corresponding one of the first terminals 61. This allows the first contact part 65 of each of the first terminals 61 to be in contact with the first contact part 165 of the corresponding one of the second terminals 161, and also allows the second contact part 66 of each of the first terminals 61 to be in contact with the second contact part 166 of the corresponding one of the second terminals 161. In addition, the engagement parts 184*b* formed in the to-be-locked parts 184 of the reinforcing metal fitting 181A and the engagement parts 184*b* formed in the to-be-locked parts 184 of the reinforcing metal fitting 181B engage with the locking tabs 84*a* of the slidable locking member 81 and the rear-end edge part 83*c* of the coupling beam part 83*a*. The first connector 1 and the second connector 101 thus become locked. Consequently, the second protruding end part 122A and the second protruding end part 122B of the second connector 101 are prevented from escaping from the mating recesses 22A and 22B of the first connector 1. This prevents the mated state of the first connector 1 and the second connector 101 from being canceled.

The operation for canceling the mating of the first connector 1 and second connector 101 having the above-mentioned configurations will be described next.

Figure 8A:
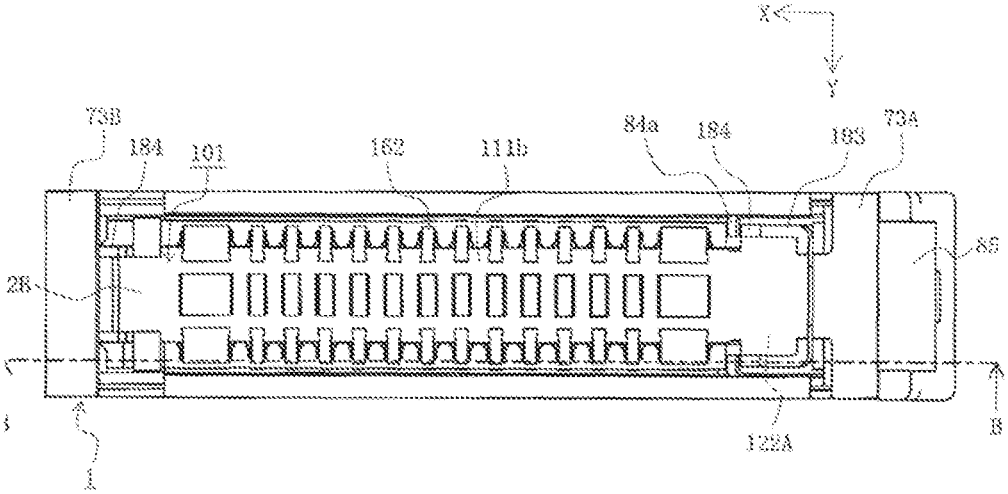
FIGS. 8A and 8B are two-surface views illustrating the operation of canceling the mating of the first and the second connectors according to the first embodiment.
Figure 8B:
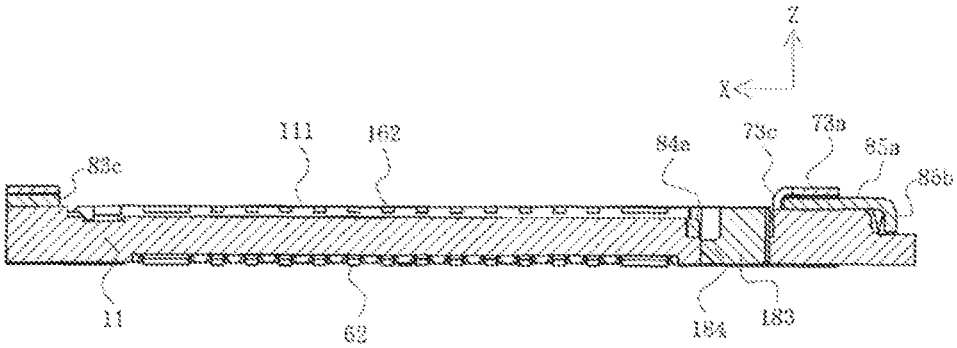
Figure 9:
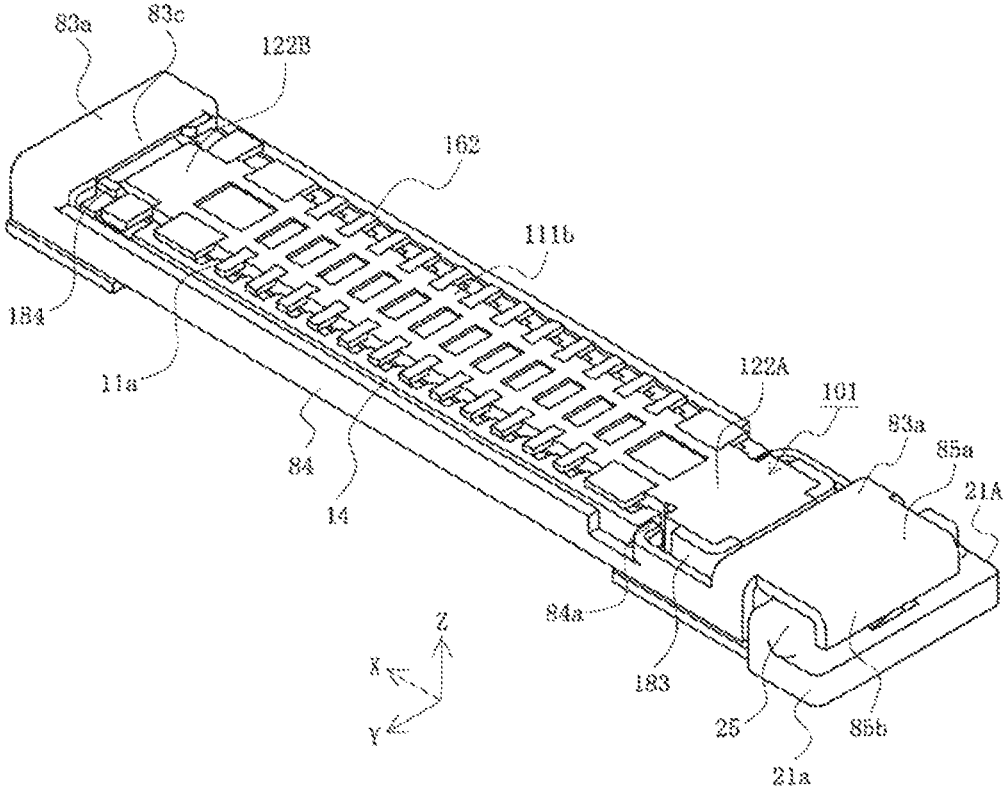
FIG. 9 is a perspective view illustrating, with the shell removed, the operation of canceling the mating of the first and the second connectors according to the first embodiment.

FIGS. 8A and 8B are two-surface views illustrating the operation of canceling the mating of the first and the second connectors according to the first embodiment. FIG. 9 is a perspective view illustrating, with the shell removed, the operation of canceling the mating of the first and the second connectors according to the first embodiment. FIG. 8A is a top view, and FIG. 8B is a cross-sectional view along the line B-B seen from arrows B in FIG. 8A.

When the operator needs to cancel the mating of the first connector 1 and the second connector 101, the operator manipulates the operation part 85 of the slidable locking member 81 to slide the slidable locking member 81 forwards (in the positive X-axis direction), and thus unlocks the to-be-locked parts 184 of the reinforcing metal fitting 181. Specifically, a forward force is applied to the operation part 85 to slide the slidable locking member 81 forwards against the biasing force of the spring 88. Note that as illustrated in FIG. 8B, once the front end of the coupling beam part 83*a* of the first end-part-coupling frame 83A is brought into contact with the stopper part 73*c* of the first end-part-coupling frame 73A of the shell 71, the forward displacement of the slidable locking member 81 stops at the unlocked position.

In this state, the locking tabs 84*a* of the slidable locking member 81 and the rear-end edge part 83*c* of the coupling beam part 83*a* that the second end-part-coupling frame 83B has are disengaged from the engagement parts 184*b* formed in the to-be-locked parts 184 of the reinforcing metal fitting 181A and the engagement parts 184*b* formed in the to-be-locked parts 184 of the reinforcing metal fitting 181B. This leaves open spaces over the engagement parts 184*b* formed in the to-be-locked parts 184 of the reinforcing metal fitting 181A and over the engagement parts 184*b* formed in the to-be-locked parts 184 of the reinforcing metal fitting 181B. The locking of the first connector 1 and the second connector is thus canceled, which allows the operator to move the first connector 1 and/or the second connector 101 in the opposite direction(s) to the mating direction(s). As a consequence, the mating of first connector 1 and second connector 101 is canceled.

As has been described thus far, the present embodiment provides the first connector 1 including the first housing 11, first terminals 61 attached to the first housing 11, and the slidable locking member 81 attached to the first housing 11. The first housing 11 includes the first protruding end parts 21A, 21B formed at the two ends, in the longitudinal direction, of the first housing 11. The first protruding end parts 21A, 21B mate with the second protruding end parts 122, which are formed at the two ends, in the longitudinal direction, of the second housing 111 of the second connector 101. The slidable locking member 81 includes the rear-end edge part 83*c* and the locking tabs 84*a*. In addition, the slidable locking member 81 is slidable in the longitudinal direction of the first housing 11 between the locked position and the unlocked position. Once the first housing 11 mates with the second housing 111 and the slidable locking member 81 slides to reach the locked position, the rear-end edge part 83*c* and the locking tabs 84*a* engage with the right-and-left pair of the to-be-locked parts 184 of the reinforcing metal fitting 181 attached to each of the second protruding end part 122.

As such, the first housing 11 and the second housing 111 are made to be mated together and the slidable locking member 81 is made to slide to reach the locked position. Consequently, the rear-end edge part 83*c* and the locking tabs 84*a* of the slidable locking member 81 engage with the right-and-left pair of the to-be-locked parts 184 of the reinforcing metal fittings 181 attached to the second protruding end parts 122. Hence, the first connector 1 and the second connector 101 are locked together by a securely mated state thereof, which is achieved easily in a short time. The mating of the first connector 1 and the second connector 101 is securely maintained to improve the reliability.

In addition, the slidable locking member 81 includes: the right-and-left pair of the side frames 84 extending along the corresponding side wall parts 14 of the first housing 11 in the longitudinal direction of the first housing 11; the pair of the end-part-coupling frames 83 each of which is configured to couple either the front ends of the side frames 84 or the rear ends of the side frames 84 and each of which is disposed in the corresponding one of the first protruding end parts 21A, 21B; and the operation part 85 formed in one of the end-part-coupling frames 83. Hence, despite its simple configuration, the slidable locking member 81 is allowed to slide smoothly in the longitudinal direction of the first housing 11, which in turn allows the locking and the unlocking operations to be performed securely.

In addition, the connector 1 includes: the right-and-left pair of the side frames 74, each of which is disposed on the outer side of the corresponding one of the side frames 84 of the slidable locking member 81, and which extend in the longitudinal direction of the first housing 11; and the pair of the end-part-coupling frames 73, each of which is disposed on the outer side of the corresponding one of the end-part-coupling frames 83 of the slidable locking member 81. The connector 1 also includes the shell 71 fixedly attached to the first housing 11. The end-part-coupling frames 73 of the shell 71 include the stopper parts 73*c* operable to stop the slidable locking member 81 at either the locked position or the unlocked position. Hence, despite the simple configuration, the slidable locking member 81 is allowed to be slidably held securely.

In addition, the connector 1 includes the spring 88 mounted in the first housing 11. The spring 88 is operable to bias the slidable locking member 81 towards the locked position. Hence, the slidable locking member 81 becomes stable at the locked position, which prevents the mating of the first connector 1 and the second connector 101 from being canceled.

Furthermore, suppose a case where the first housing 11 and the second housing 111 are mated together. In this case, once the rear-end edge part 83*c* and the locking tab 84*a* have been brought into contact with the sloping part 184*a* formed in the to-be-locked parts 184, the rear-end edge part 83*c* and the locking tab 84*a* receive a force, from the sloping part 184*a*, directed towards the unlocked position. This makes the slidable locking member 81 slide and reach the unlocked position. Once the rear-end edge part 83*c* and the locking tab 84*a* have passed by the to-be-locked parts 184 in the mating direction, the biasing force of the spring 88 makes the slidable locking member 81 slide and reach the locked position. This makes the rear-end edge part 83*c* and the locking tab 84*a* engage with the to-be-locked parts 184. Hence, to lock the first connector 1 and the second connector 101 together, the operator does not have to perform any operation to slide the slidable locking member 81. The only thing that the operator has to do to this end is mating the first housing 11 and the second housing 111 together.

Next, a second embodiment will be described. Note that the description of objects having the same structures as those of the first embodiment will be omitted by being denoted by the same reference numerals. Furthermore, the description of operations and effects that are the same as those of the first embodiment will be omitted.

Figure 10B:
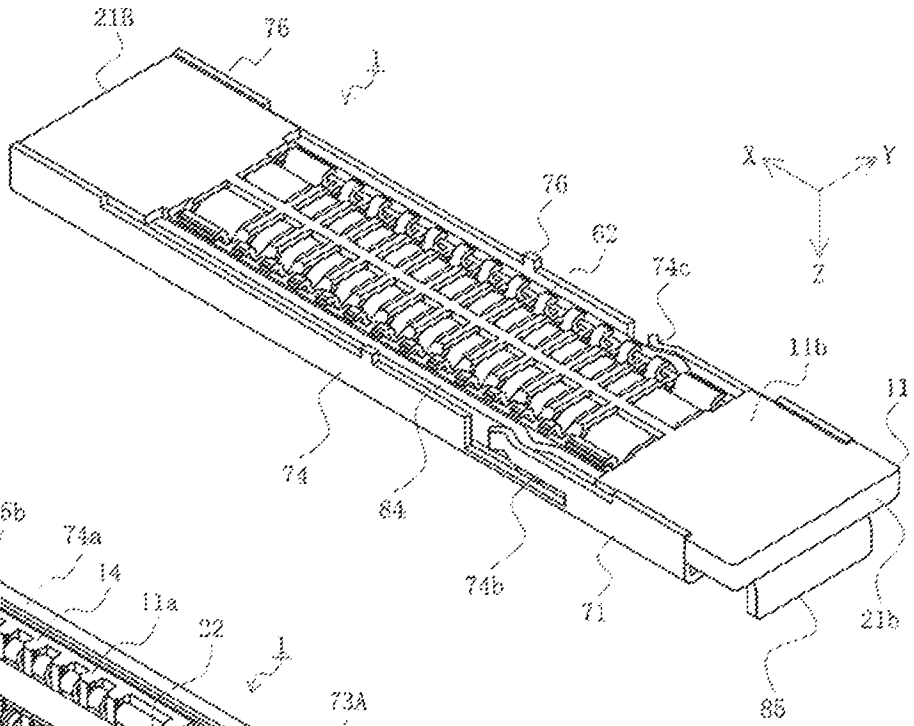
FIGS. 10A and 10B show perspective views of a first connector according to a second embodiment.
Figure 10A:
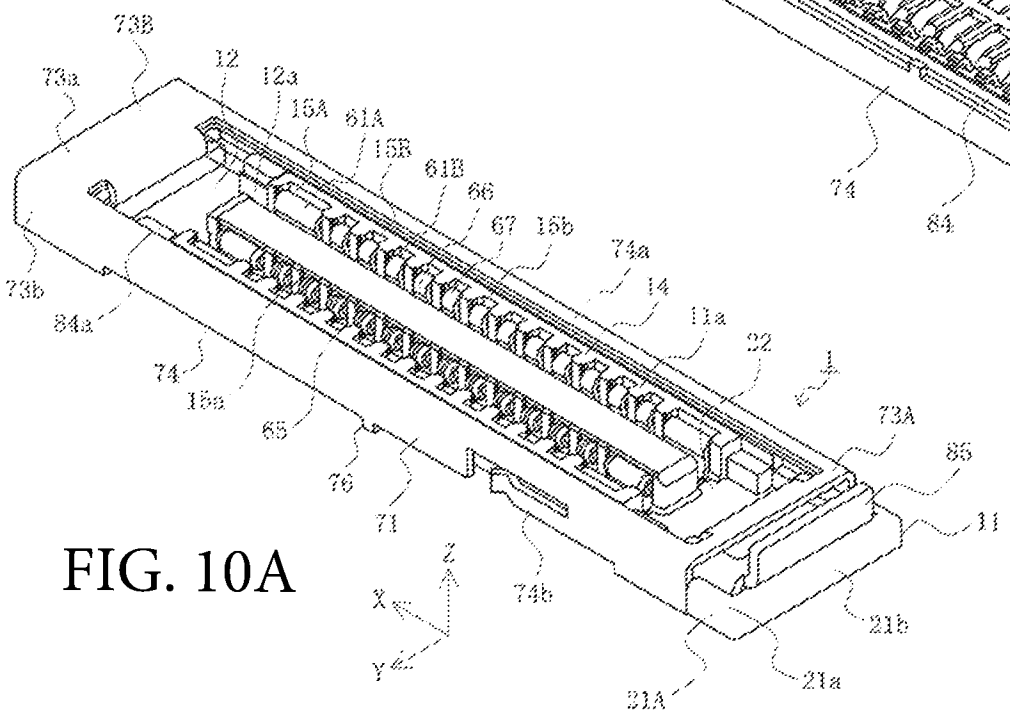
Figure 11A:
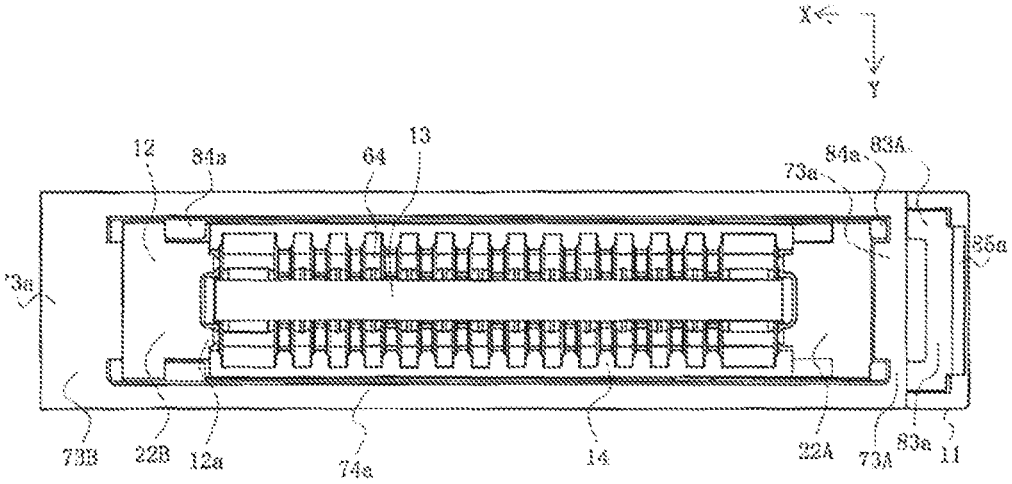
FIGS. 11A and 11B are two-surface views of the first connector according to the second embodiment.
Figure 11B:
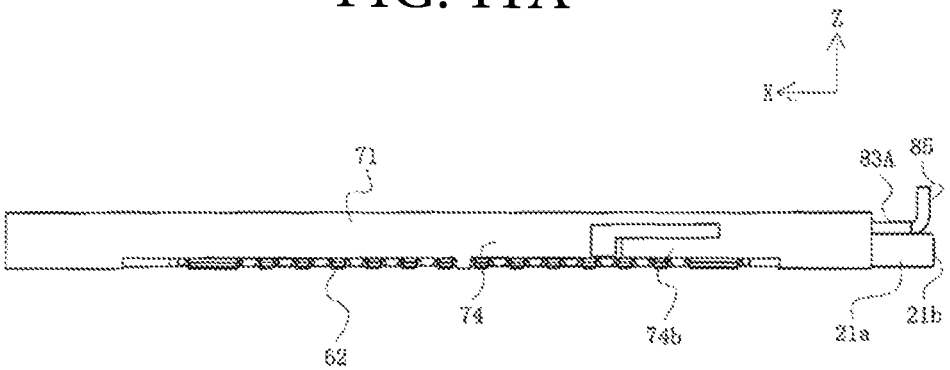
Figure 12:
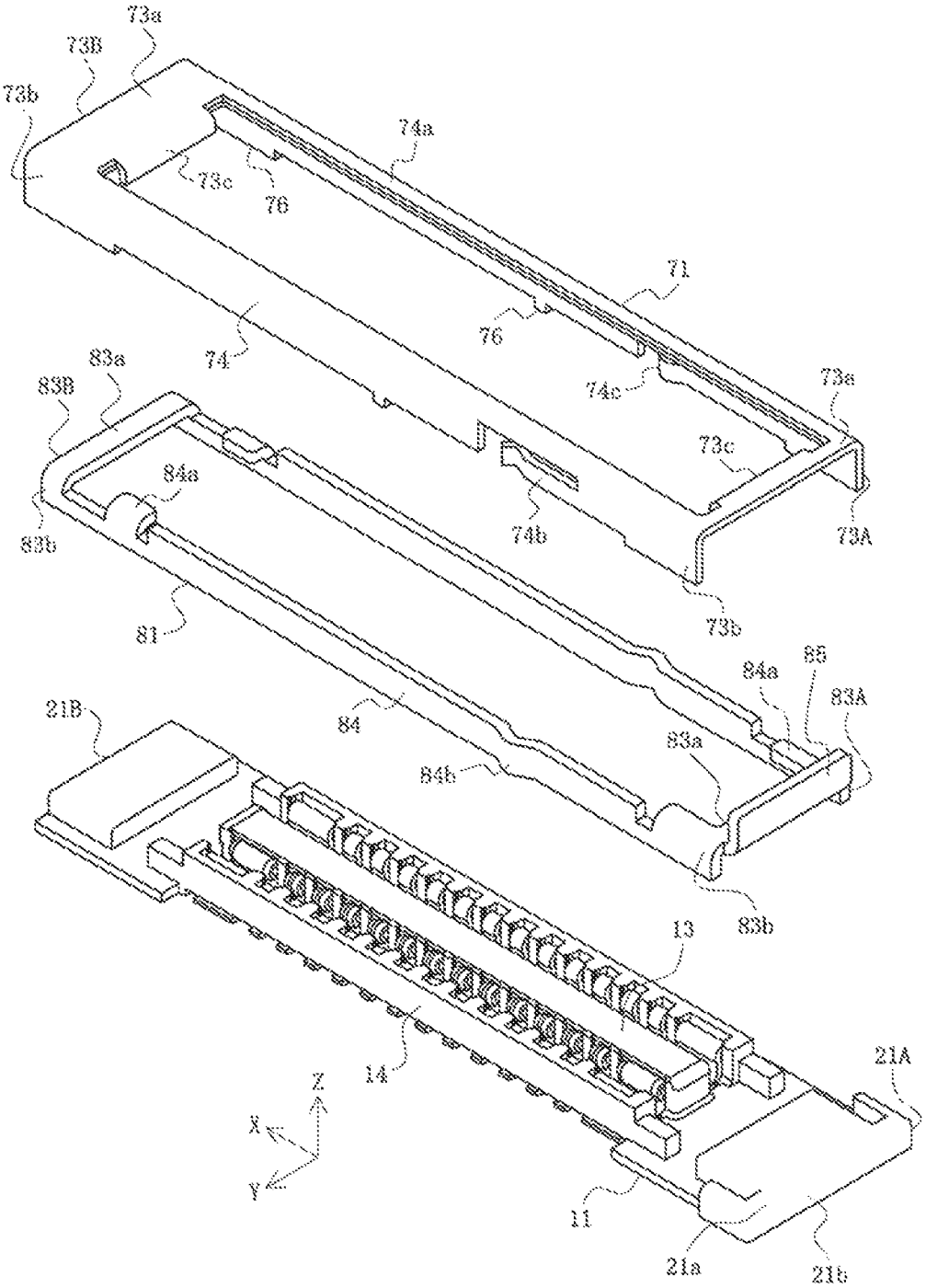
FIG. 12 is an exploded view of the first connector according to the second embodiment.

FIGS. 10A and 10B show perspective views of a first connector according to a second embodiment. FIGS. 11A and 11B are two-surface views of the first connector according to the second embodiment. FIG. 12 is an exploded view of the first connector according to the second embodiment. Note that, FIG. 10A is a view from a mating face side, and FIG. 10B is a view from a mounting face side. FIG. 11A is a top view, and FIG. 11B is a side view.

In the present embodiment, the first protruding end part 21A of the first housing 11 has neither the bulging-out part 25 nor the spring-accommodating recessed part 26 formed in the first connector 1. Hence, no such spring 88 that was described above in the first embodiment is not attached.

In addition, the operation part 85 that the first end-part-coupling frame 83A of the slidable locking member 81 of the present embodiment has is formed to extend upwards (in the positive Z-axis direction) from the rear end of the coupling beam part 83*a*. The operation part 85 of the present embodiment includes neither the top plate part 85*a* nor the rear plate part 85*b*, which is different from the corresponding arrangement in the first embodiment. In addition, in the present embodiment, the locking tabs 84*a* formed in the right-hand-side and the left-hand-side side frames 84 are formed not only at positions facing the mating recess 22A but also at positions facing the mating recess 22B. The locking tabs 84*a* at positions facing the mating recess 22A function as rear-side locking parts whereas the locking tabs 84*a* at positions facing the mating recess 22B function as front-side locking parts. Note that unlike the locking tabs 84*a* in the first embodiment, the locking tabs 84*a* in the second embodiment are not formed by cutting a portion of the corresponding side frames 84 near the top ends thereof and by raising up the cut portions. Instead, the locking tabs 84*a* in the second embodiment are eaves-like members each of which protrudes towards the inner side of the mating recess 22A from the top end of the corresponding one of the side frames 84. In addition, the right-hand-side and left-hand-side side frames 84 have engagement projections 84*b* formed therein as the to-be-held parts. Each of the engagement projections 84*b* bulges outwards, in the width direction, of the first housing 11.

Moreover, in the shell 71 of the present embodiment, an additional stopper part 73*c* is formed at the rear end of the coupling beam part 73*a* that the second end-part-coupling frame 73B has. The additional stopper part 73*c* has a curved shape such that the distal end thereof is directed downwards. Protruding engagement pieces 74*b* extending forwards are formed in the right-hand-side and the left-hand-side side frames 74. Each of the protruding engagement pieces 74*b* is formed by cutting a portion of the corresponding side frame 74 near the bottom end thereof and by raising up the cut portion. The base end is connected integrally with the corresponding side frame 74. Each of the protruding engagement pieces 74*b* is made of a cantilever-type elongated plate material with its distal end (i.e., free end) facing forwards. The external surfaces of the protruding engagement pieces 74*b* are substantially flush with the external surfaces of their respective side frames 74. In addition, each of the protruding engagement pieces 74*b* is a leaf spring whose distal end is elastically displaceable in the width direction of the first housing 11. The protruding engagement pieces 74*b* function as engagement members configured to engage the slidable locking member 81. In the vicinity of the distal end of each protruding engagement piece 74*b*, an engagement projection 74*c* is formed to bulge out inwards, in the width direction, of the first housing 11. The engagement projections 74*c* engage with the engagement projections 84*b* of the slidable locking member 81.

It should be noted that descriptions of configurations of other aspects of the first connector 1 that are the same as those in the first embodiment will be omitted.

Next, a configuration of a second connector 101 according to the present embodiment will be described.

Figure 13B:
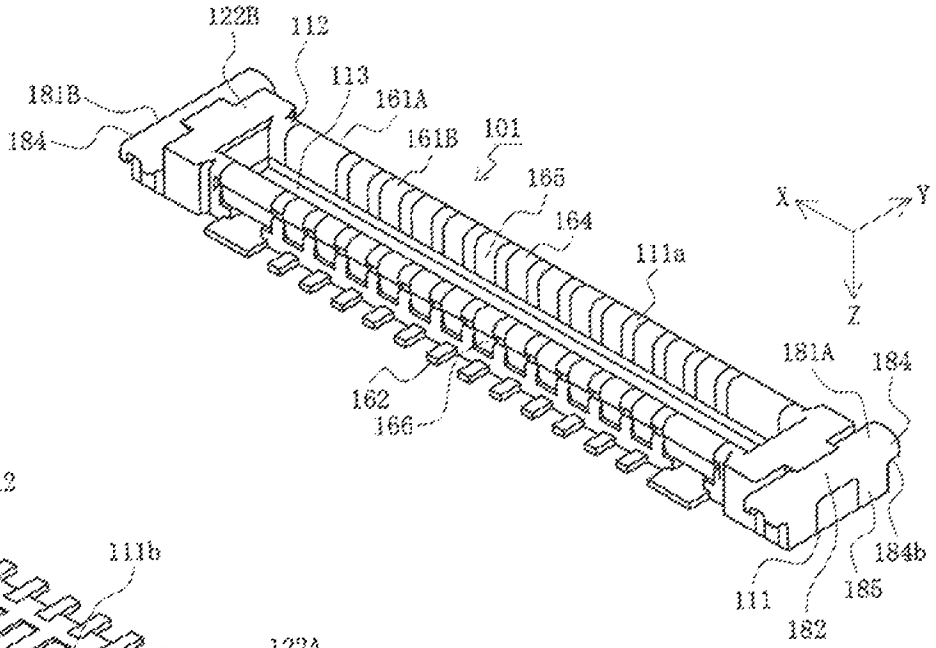
FIGS. 13A and 13B show perspective views of a second connector according to the second embodiment.
Figure 13A:
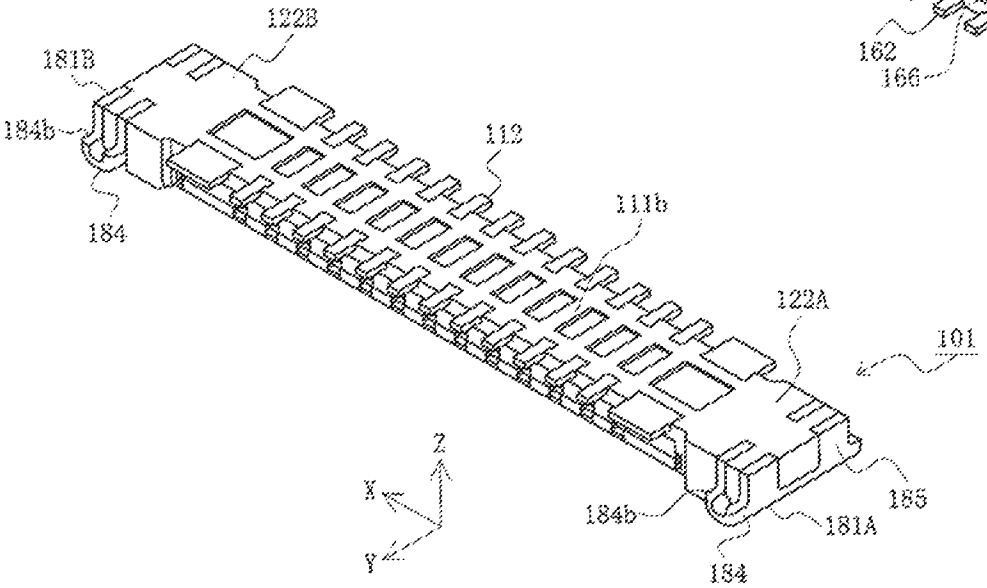
Figure 14A:
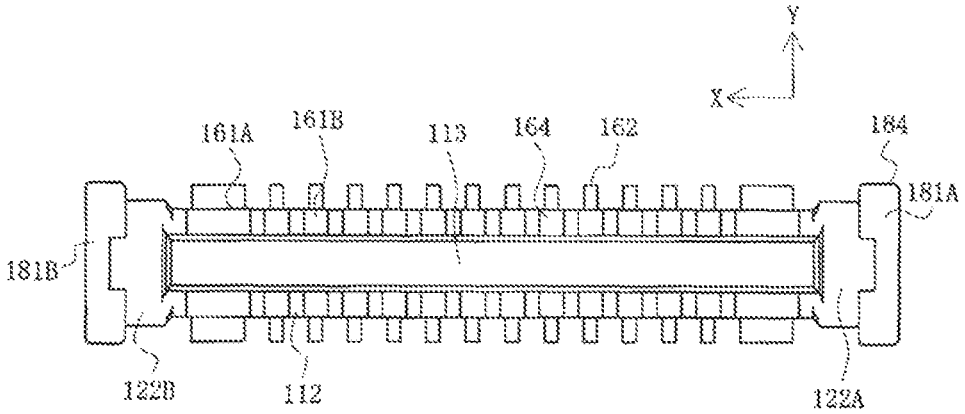
FIGS. 14A and 14B are two-surface views of the second connector according to the second embodiment.
Figure 14B:
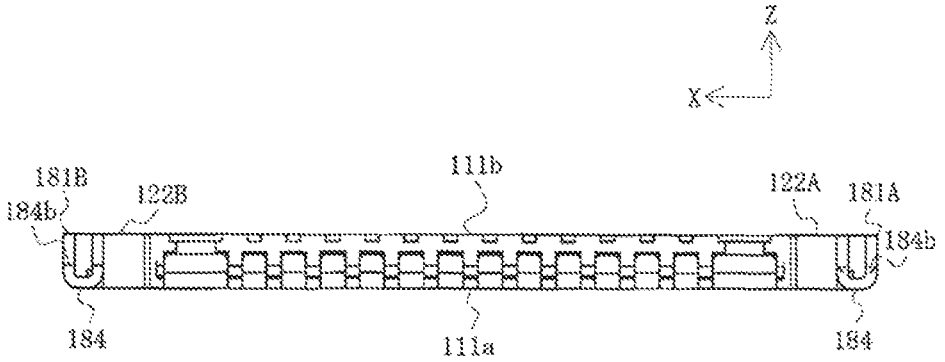

FIGS. 13A and 13B show perspective views of a second connector according to the second embodiment. FIGS. 14A and 14B are two-surface views of the second connector according to the second embodiment. Note that, FIG. 13A is a view from the mounting face side and FIG. 13B is a view from the mating face side. FIG. 14A is a top view and FIG. 14B is a side view.

In the second connector 101 of the present embodiment, the second housing 111 has the second protruding end part 122A and the second protruding end part 122B that have similar configurations. In addition, the reinforcing metal fitting 181A attached to the second protruding end part 122A and the reinforcing metal fitting 181B attached to the second protruding end part 122B have similar configurations. The main body part 182 of each of the reinforcing metal fittings 181 is a gutter-like member having a substantially U-shaped cross section and extending in the width direction of the second housing 111. The main body part 182 is attached so as to cover a portion of the second housing 111 in the top surface (i.e., a surface on the negative Z-axis direction side) of the second protruding end part 122, the portion being a portion near the corresponding end, in the longitudinal direction, of the second housing 111. From the bottom end of main body part 182, a plurality of connection legs 185 extend downwards (in the positive Z-axis direction). Note that the bottom end of each of the connection legs 185 is connected by soldering or the like method to a connection pad formed on the corresponding surface of the second substrate. Note that each of the reinforcing metal fitting 181 according to the present embodiment includes neither the side-covering part 183 nor the connection piece 186.

In addition, the to-be-locked parts 184 extend from the corresponding two ends, in the width direction of the second housing 111, of each of the main body parts 182. Each of the to-be-locked parts 184 protrudes outwards from the corresponding one of the right-hand-side and the left-hand-side side surfaces of the second protruding end part 122. In addition, at an end part of the to-be-locked part 184 located on the mounting face 111*b* side, that is, the bottom end of the to-be-locked part 184, an engagement part 184*b* is formed so as to extend in parallel to the mounting face 111*b* and in the width direction of the second housing 111. No sloping part 184*a* is formed in the to-be-locked parts 184 according to the present embodiment.

It should be noted that descriptions of configurations of other aspects of the second connector 101 that are the same as those in the first embodiment will be omitted.

The operation for mating first connector 1 and second connector 101 having the above-mentioned configuration will be described next.

Figure 15A:
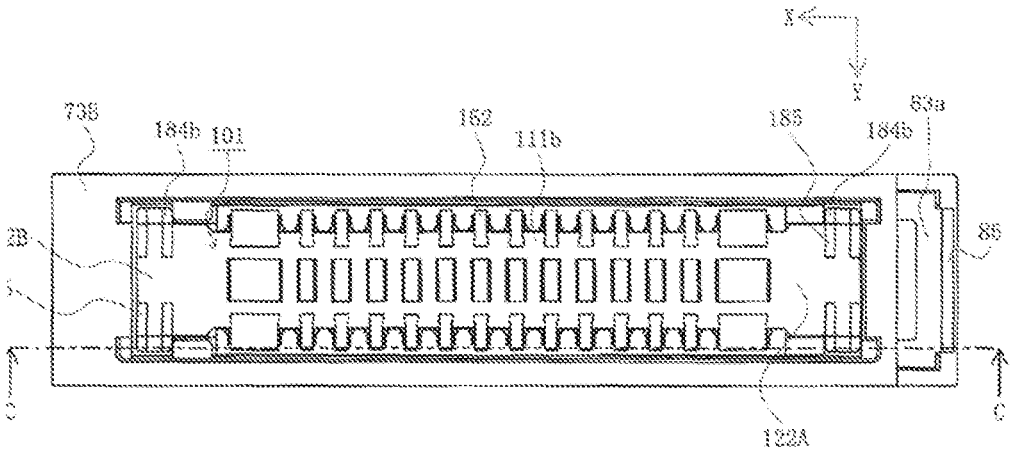
FIGS. 15A and 15B are two-surface views illustrating a state in which the first connector and the second connector according to the second embodiment have not been locked yet.
Figure 15B:
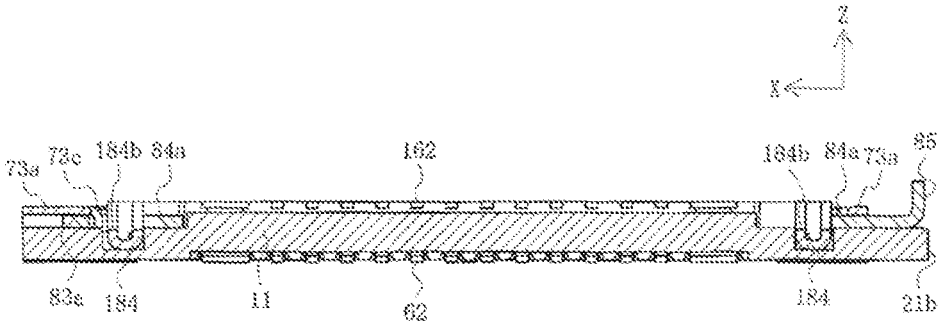
Figure 16:
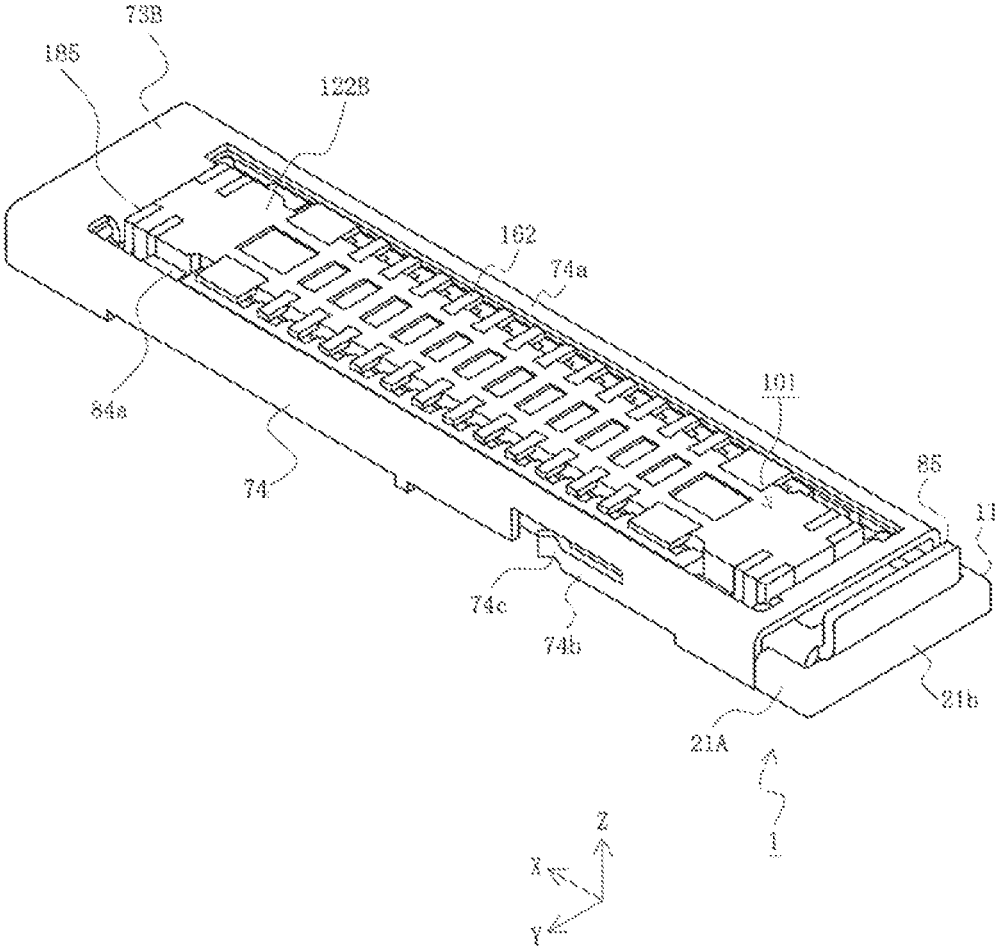
FIG. 16 is a perspective view illustrating the state in which the first connector and the second connector according to the second embodiment have not been locked yet.
Figure 17A:
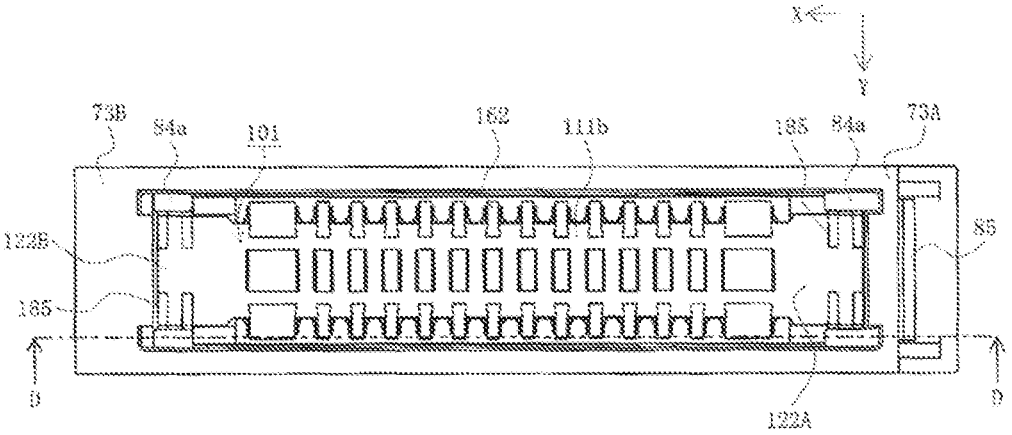
FIGS. 17A and 17B are two-surface views illustrating a state in which the first connector and the second connector according to the second embodiment are locked.
Figure 17B:
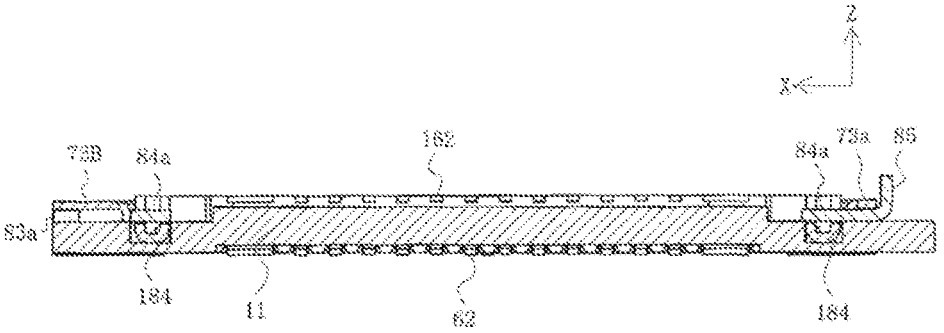
Figure 18:
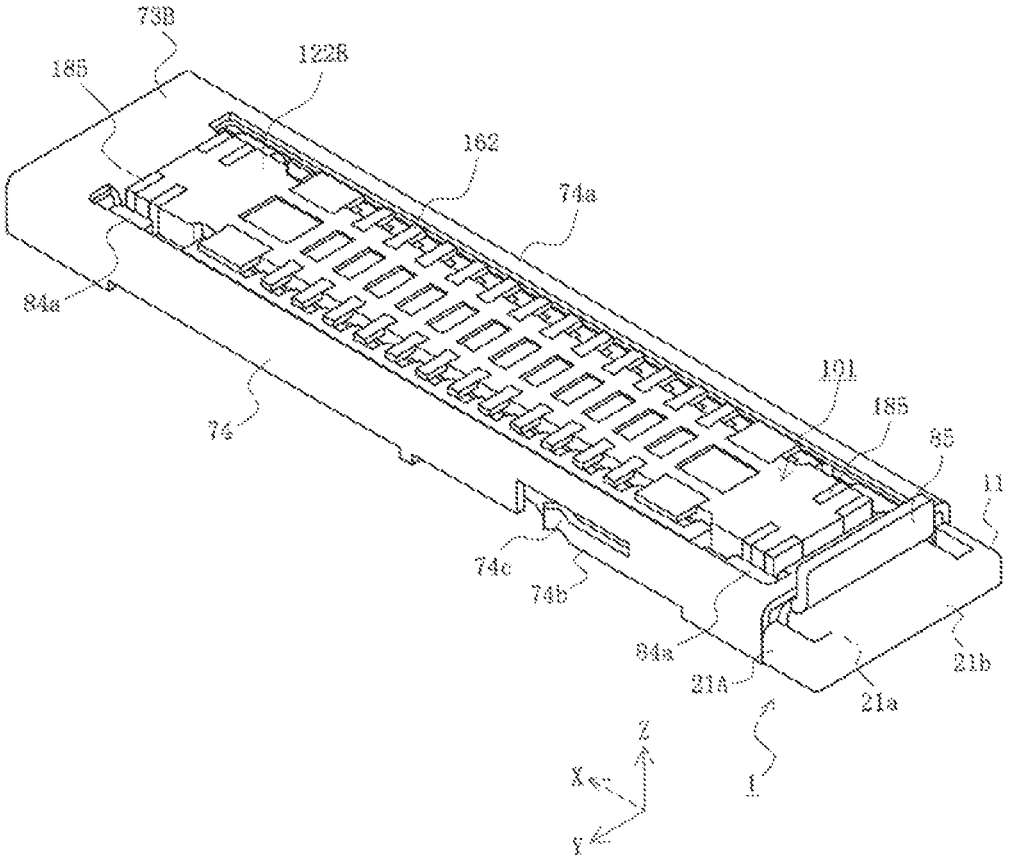
FIG. 18 is a perspective view illustrating the state in which the first connector and the second connector according to the second embodiment are locked.
Figure 19:
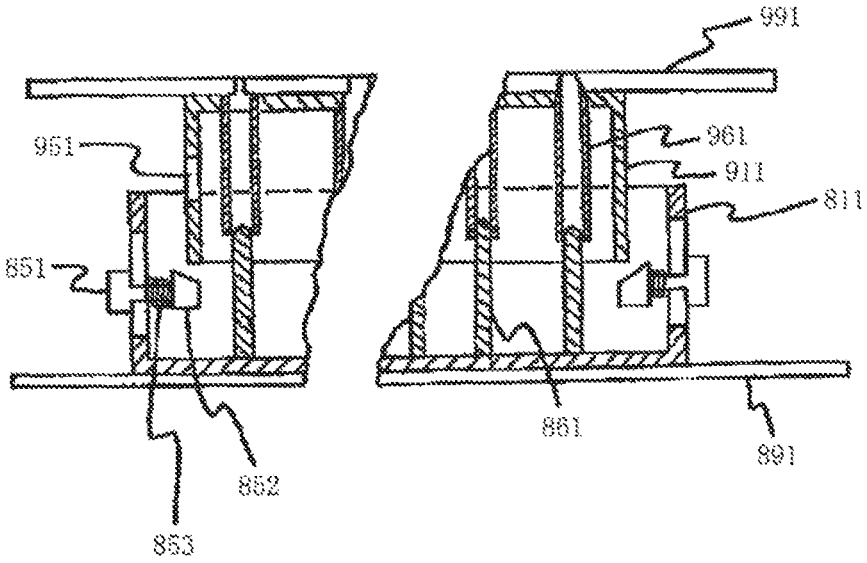
FIG. 19 Prior Art
FIG. 19 is a partial cross-sectional view of a conventional connector.

FIGS. 15A and 15B are two-surface views illustrating the state in which the first connector and the second connector according to the second embodiment have not been locked yet. FIG. 16 is a perspective view illustrating the state in which the first connector and the second connector according to the second embodiment have not been locked yet. FIGS. 17A and 17B are two-surface views illustrating a state in which the first connector and the second connector according to the second embodiment are locked. FIG. 18 is a perspective view illustrating the state in which the first connector and the second connector according to the second embodiment are locked. FIG. 15A is a top view, and FIG. 15B is a cross-sectional view along the line C-C seen from arrows C in FIG. 15A. FIG. 17A is a top view, and FIG. 17B is a cross-sectional view along the line D-D seen from arrows D in FIG. 17A.

Firstly, the operator manipulates the operation part 85 of the slidable locking member 81 so as to cause the slidable locking member 81 slide rearwards (i.e., in the negative X-axis direction) until the slidable locking member 81 is located at the unlocked position as illustrated in FIGS. 10A-B and FIGS. 11A-B. Note that as illustrated in FIG. 15B, once the rear end of the coupling beam part 83*a* of the second end-part-coupling frame 83B is brought into contact with the stopper part 73*c* formed in the rear end of the coupling beam part 73*a* of the second end-part-coupling frame 73B of the shell 71, the slidable locking member 81 stops its rearward displacement and reaches the unlocked position.

In addition, when the slidable locking member 81 slides rearwards and reaches the unlocked position, the engagement projections 84*b* of the slidable locking member 81 advance beyond the corresponding engagement projections 74*c* formed in the protruding engagement pieces 74*b* of the shell 71, and engage with the rear ends of the engagement projections 74*c*. As such, the engagement projections 84*b* and the engagement projections 74*c* engage with each other, the slidable locking member 81 is prevented from sliding forwards (i.e., in the positive X-axis direction) from the unlocked position. In addition, as the operator can sense the clicking feeling caused by the engagement projections 84*b* advance beyond the corresponding engagement projections 74*c*, the operator can recognize, without failure, the arrival of the slidable locking member 81 at the unlocked position.

Then, the operator places the first connector 1 and the second connector 101 so that the mating face 11*a* of the first housing 11 of the first connector 1 and the mating face 111*a* of the second housing 111 of the second connector 101 face each other, which means that the first connector 1 and the second connector 101 are completely aligned. Then, the operator moves the first connector 1 and/or the second connector 101 in the mating direction(s) (in the Z-axis direction(s)). The second protruding end parts 122A and 122B on the second connector 101 are thus inserted respectively in the mating recesses 22A and 22B on the first connector 1.

When this occurs, the locking tabs 84*a* of the slidable locking member 81 are located at rear positions in the mating recess 22A and in the mating recess 22B. Hence, the to-be-locked parts 184 of the reinforcing metal fittings 181 in the second connector 101 are not in contact with the locking tabs 84*a*, and are thus allowed to be displaced downwards, that is, towards the mounting face 11*b* of the first housing 11 (i.e., in the negative Z-axis direction) through either the inside of the mating recess 22A or the mating recess 22B. Once the insertion of the second protruding end part 122A and the second protruding end part 122B of the second connector 101 respectively into the mating recess 22A and the mating recess 22B of the first connector 1 is completed, the engagement parts 184*b* of the to-be-locked parts 184 are positioned below the level of the locking tabs 84*a*, as illustrated in FIG. 15B.

Then, the operator manipulates the operation part 85 of the slidable locking member 81 so as to cause the slidable locking member 81 slide forwards (i.e., in the positive X-axis direction) until the slidable locking member 81 is located at the locked position as illustrated in FIGS. 17A-B and FIG. 18. Note that once the front end of the coupling beam part 83*a* of the first end-part-coupling frame 83A is brought into contact with the stopper part 73*c* formed in the front end of the coupling beam part 73*a* of the first end-part-coupling frames 73A of the shell 71, the slidable locking member 81 stops its forward displacement and reaches the locked position.

In addition, when the slidable locking member 81 slides forwards and reaches the locked position, the engagement projections 84*b* of the slidable locking member 81 advance beyond the corresponding engagement projections 74*c* formed in the protruding engagement pieces 74*b* of the shell 71, and engage with the front ends of the engagement projections 74*c*. As such, the engagement projections 84*b* and the engagement projections 74*c* engage with each other, the slidable locking member 81 is prevented from sliding rearwards from the locked position, and is thus prevented from being unlocked. In addition, as the operator can sense the clicking feeling caused by the engagement projections 84*b* advance beyond the corresponding engagement projections 74*c*, the operator can recognize, without failure, the arrival of the slidable locking member 81 at the locked position.

Once the slidable locking member 81 has reached the locked position, the locking tabs 84*a* of the slidable locking member 81 engage, from above, with the engagement parts 184*b* formed in the to-be-locked parts 184 of the reinforcing metal fittings 181 in the second connector 101. The to-be-locked parts 184 of the reinforcing metal fittings 181 are thus locked by the slidable locking member 81, which causes the first connector 1 and the second connector 101 to be locked with each other.

In this way, once the first connector 1 and the second connector 101 are fully mated together, and the first connector 1 and the second connector 101 thus become locked, each of the second terminals 161 of the second connector 101 is inserted in the interstice between the first contact part 65 and the second contact part 66 of the corresponding one of the first terminals 61. This allows the first contact part 65 of each of the first terminals 61 to be in contact with the first contact part 165 of the corresponding one of the second terminals 161, and also allows the second contact part 66 of each of the first terminals 61 to be in contact with the second contact part 166 of the corresponding one of the second terminals 161. In addition, the engagement parts 184*b* formed in the to-be-locked parts 184 of the reinforcing metal fittings 181 engage with the locking tab 84*a* of the slidable locking member 81. The first connector 1 and the second connector 101 thus become locked. Consequently, the second protruding end part 122A and the second protruding end part 122B of the second connector 101 are prevented from escaping from the mating recesses 22A and 22B of the first connector 1. This prevents the mated state of the first connector 1 and the second connector 101 from being canceled.

It should be noted that descriptions of operations of other aspects of the first connector 1 and the second connector 101 that are the same as those in the first embodiment will be omitted.

As such, the first connector 1 according to the present embodiment further includes the protruding engagement pieces 74*b* configured to engage with the slidable locking member 81, and the slidable locking member 81 is engaged with by the protruding engagement piece 74*b* at the locked position and at the unlocked position. Hence, the first connector 1 and the second connector 101 are mated together easily without allowing the slidable locking member 81 to slide unnecessarily. In addition, the first connector 1 and the second connector 101 are allowed to be securely locked together.

In addition, each of the protruding engagement pieces 74*b* is a leaf spring whose distal end is elastically displaceable in the width direction of the first housing 11. The engagement projection 74*c* formed in the vicinity of the free end engages with the corresponding engagement projection 84*b* of the slidable locking member 81, and thus the slidable locking member 81 is engaged. Hence, the engagement and the disengagement of the slidable locking member 81 can be achieved easily.

Note that the present disclosure is only one example, and thus any appropriate change that preserves the gist of the present disclosure and can easily be conceived of by a person skilled in the art is within the scope of the present disclosure. The widths, thicknesses, and shapes of the portions illustrated in the drawings are illustrated schematically and are not intended to limit the interpretation of the present disclosure.

In addition, the disclosures of the present description set out characteristics related to preferred and exemplary embodiments. Various other embodiments, modifications and variations within the scope and spirit of the claims appended hereto could naturally be conceived of by a person skilled in the art by summarizing the disclosures of the present description.

The present disclosure is applicable to a connector and a connector assembly.

The invention claimed is:

1. A connector comprising:

a connector body;

a terminal attached to the connector body; and a slider attached to the connector body, wherein the connector body includes mating-guide parts formed on two ends, in the longitudinal direction, of the connector body;

the mating guide parts mate with counterpart mating-guide parts formed on the two ends, in the longitudinal direction, of a counterpart connector body of a counterpart connector;

the slider includes a front-side locking part and a rear-side locking part, and is slidable, in the longitudinal direction of the connector body, between a locked position and an unlocked position; and once the connector body mates with the counterpart connector body, and the slider slides and thus reaches the locked position, the front-side locking part and the rear-side locking part engage with a right-and-left pair of to-be-locked parts of a counterpart locking member attached to each of the counterpart mating-guide parts.

2. The connector according to claim 1, wherein the slider includes:

a right-and-left pair of side frames extending along a side wall part of the connector body in the longitudinal direction of the connector body;

a pair of end-part-coupling frames disposed in each of the mating guide parts and configured to couple two ends of the side frames at a front position and to couple two ends thereof at a rear position; and an operation part formed in one of the end-part-coupling frames.

3. The connector according to claim 2, further comprising a shell attached fixedly to the connector body and including:

a right-and-left pair of side frames disposed on outer sides of the side frames of the slider and extending in the longitudinal direction of the connector body; and a pair of end-part-coupling frames disposed on outer sides of the end-part-coupling frames of the slider, wherein the end-part-coupling frames of the shell include stopper parts configured to stop the slider at the locked position or the unlocked position.

4. The connector according to claim 1, further comprising a biasing member mounted in the connector body, wherein the biasing member biases the slider towards the locked position.

5. The connector according to claim 4, wherein in a case where the connector body is mated with the counterpart connector body:

if the front-side locking part and the rear-side locking part are brought into contact with sloping parts formed in the to-be-locked parts and thus receive a force directed towards an unlocked position from the sloping part, the slider slides and thus reaches an unlocked position, and if the front-side locking part and the rear-side locking part pass through the to-be-locked parts in a mating direction, a biasing force of the biasing member makes the slider slide and thus reach to a locked position, and the front-side locking part and the rear-side locking part engage with the to-be-locked parts.

6. The connector according to claim 1, further comprising a shell which is fixedly attached to the connector body so as to cover the slider from outside, the shell having an engagement member that is configured to engage with the slider.

7. The connector according to claim 6, wherein the engagement member is a leaf spring whose free end is elastically displaceable in the width direction of the connector body; and the engagement member having an engagement projection formed in a vicinity of a free end thereof, the engagement projection of the engagement member is configured to engage with an engagement projection of the slider.

8. A connector assembly comprising:

a connector according to claim 1; and a counterpart connector including a counterpart connector body, wherein the counterpart connector body includes counterpart mating guide parts formed at two ends, in the longitudinal direction, of the counterpart connector body;

the counterpart mating guide parts are configured to mate with mating guide parts of the connector; and counterpart locking members are attached to the counterpart mating guide parts of the counterpart connector body.

* * * * *